US006049165A

United States Patent [19]

Spindt et al.

[11] Patent Number: 6,049,165

[45] Date of Patent: Apr. 11, 2000

[54] STRUCTURE AND FABRICATION OF FLAT PANEL DISPLAY WITH SPECIALLY ARRANGED SPACER

[75] Inventors: Christopher J. Spindt, Menlo Park; John E. Field, Dorrington, both of Calif.

[73] Assignee: Candescent Technologies Corporation, San Jose, Calif.

[21] Appl. No.: 09/008,129

[22] Filed: Jan. 16, 1998

Related U.S. Application Data

[63] Continuation-in-part of application No. 08/684,270, Jul. 17, 1996, Pat. No. 5,859,502.

[51] Int. Cl.[7] ..... H01J 63/04; H01J 29/18

[52] U.S. Cl. ..... 313/495; 313/422; 313/292; 313/496; 315/169.1; 315/169.3

[58] Field of Search ..... 313/495, 496, 313/497, 292, 422, 309, 336, 351, 258, 306; 315/169.1, 169.3; 445/24, 25; 427/510, 77

[56] References Cited

U.S. PATENT DOCUMENTS

| | | | |
|---|---|---|---|
| 3,935,499 | 1/1976 | Oess | 313/413 |
| 4,174,523 | 11/1979 | Marlowe et al. | 358/67 |
| 4,451,759 | 5/1984 | Heynisch | 313/495 |
| 4,757,230 | 7/1988 | Washington et al. | 313/422 |
| 4,769,575 | 9/1988 | Murata et al. | 313/495 |
| 4,857,799 | 8/1989 | Spindt et al. | 313/495 |
| 4,900,981 | 2/1990 | Yamazaki et al. | 313/422 |
| 4,923,421 | 5/1990 | Brodie et al. | 445/24 |
| 5,003,219 | 3/1991 | Muragishi et al. | 313/456 |
| 5,015,912 | 5/1991 | Spindt et al. | 313/495 |
| 5,063,327 | 11/1991 | Brodie et al. | 313/482 |
| 5,083,058 | 1/1992 | Nonomura et al. | 313/482 |
| 5,130,614 | 7/1992 | Staelin | 315/366 |
| 5,160,871 | 11/1992 | Tomii et al. | 315/366 |
| 5,227,691 | 7/1993 | Murai et al. | 313/422 |
| 5,229,691 | 7/1993 | Shichao et al. | 315/366 |
| 5,313,136 | 5/1994 | Van Gorkom et al. | 313/422 |
| 5,424,605 | 6/1995 | Lovoi | 313/422 |
| 5,448,131 | 9/1995 | Taylor et al. | 313/309 |
| 5,486,126 | 1/1996 | Cathey et al. | 445/25 |
| 5,528,103 | 6/1996 | Spindt et al. | 313/497 |
| 5,529,524 | 6/1996 | Jones | 445/24 |
| 5,532,548 | 7/1996 | Spindt et al. | 313/422 |
| 5,543,683 | 8/1996 | Haven et al. | 313/461 |
| 5,562,517 | 10/1996 | Taylor et al. | 445/25 |
| 5,578,899 | 11/1996 | Haven et al. | 313/422 |
| 5,589,731 | 12/1996 | Fahlen et al. | 313/495 |
| 5,598,056 | 1/1997 | Jin et al. | 313/495 |
| 5,619,097 | 4/1997 | Jones | 313/495 |
| 5,650,690 | 7/1997 | Haven | 313/422 |
| 5,663,608 | 9/1997 | Jones et al. | 313/309 |
| 5,667,418 | 9/1997 | Fahlen et al. | 445/25 |
| 5,675,212 | 10/1997 | Schmid et al. | 313/422 |

FOREIGN PATENT DOCUMENTS

| | | |
|---|---|---|
| 0 050 294 A1 | 4/1982 | European Pat. Off. . |
| 0 405 262 A1 | 1/1991 | European Pat. Off. . |
| 0 436 997 A1 | 7/1991 | European Pat. Off. . |
| 0 523 702 A1 | 1/1993 | European Pat. Off. . |
| 0 580 244 a1 | 1/1994 | European Pat. Off. . |
| 0 780 872 A1 | 6/1997 | European Pat. Off. . |
| 0 780 873 A1 | 6/1997 | European Pat. Off. . |
| WO 97/15912 | 5/1997 | WIPO . |

*Primary Examiner*—Nimeshkumar D. Patel
*Assistant Examiner*—Joseph Williams
*Attorney, Agent, or Firm*—Skjerven, Morrill, MacPherson, Franklin & Friel LLP; Ronald J. Meetin

[57] ABSTRACT

A flat-panel display having a backplate structure (330), a faceplate structure (320), and a spacer (340) situated between the two plate structures is configured so that the electric potential field along the spacer approximates the potential field that would be present at the same location in free space, i.e., in the absence of the spacer, between the two plate structures. Consequently, the presence of the spacer does not significantly affect the trajectories of electrons moving from the backplate structure to the faceplate structures. Alternatively, the spacer is arranged to produce electron deflection that largely compensates for undesired electron deflection which occurs during earlier electron travel from the backplate structure to the faceplate structure. The net electron deflection is small.

60 Claims, 19 Drawing Sheets

Fig. 18a
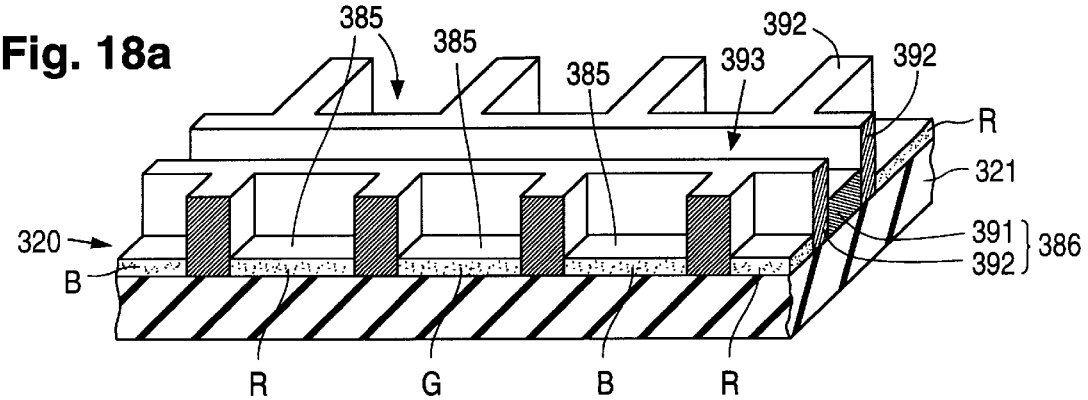
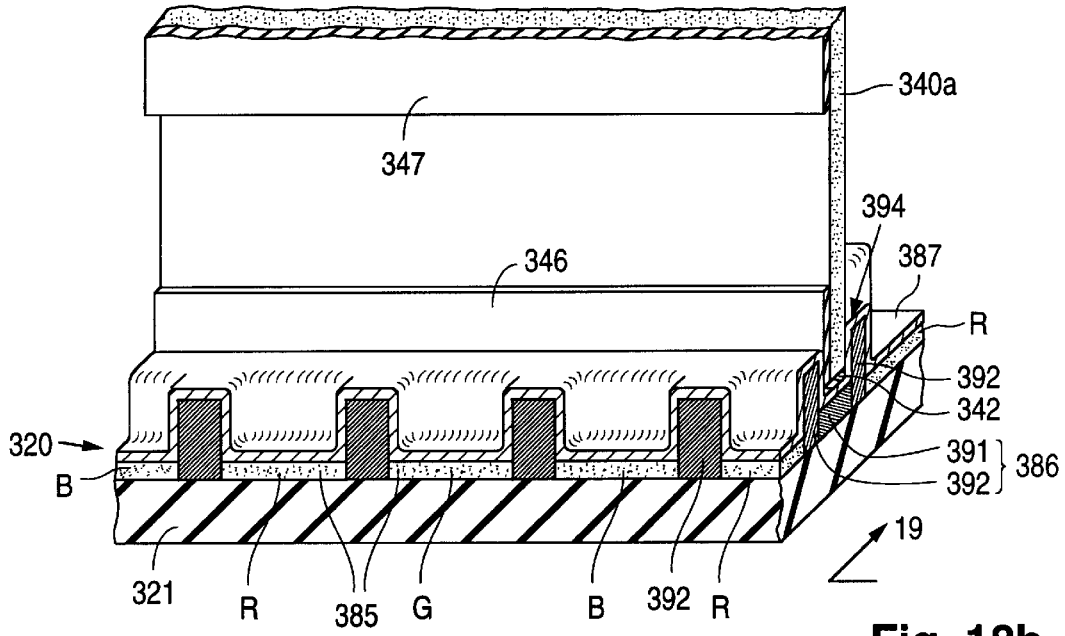
Fig. 18b
Fig. 19
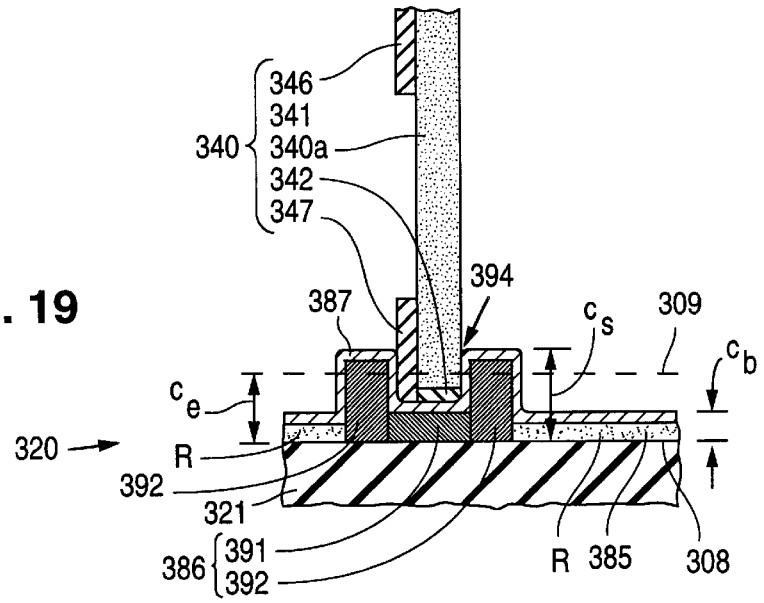

Fig. 20a
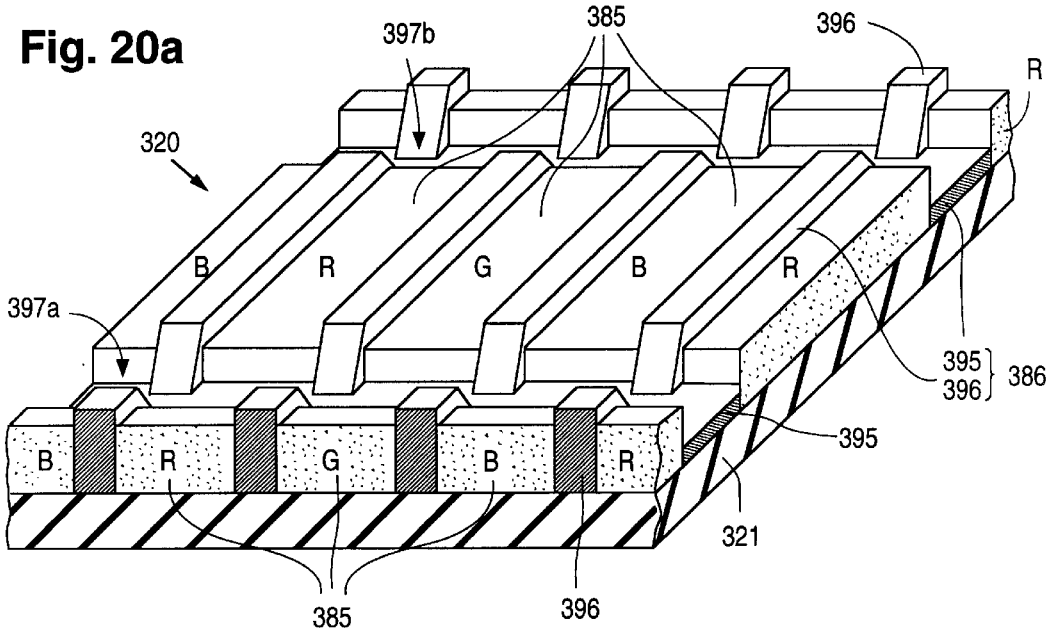
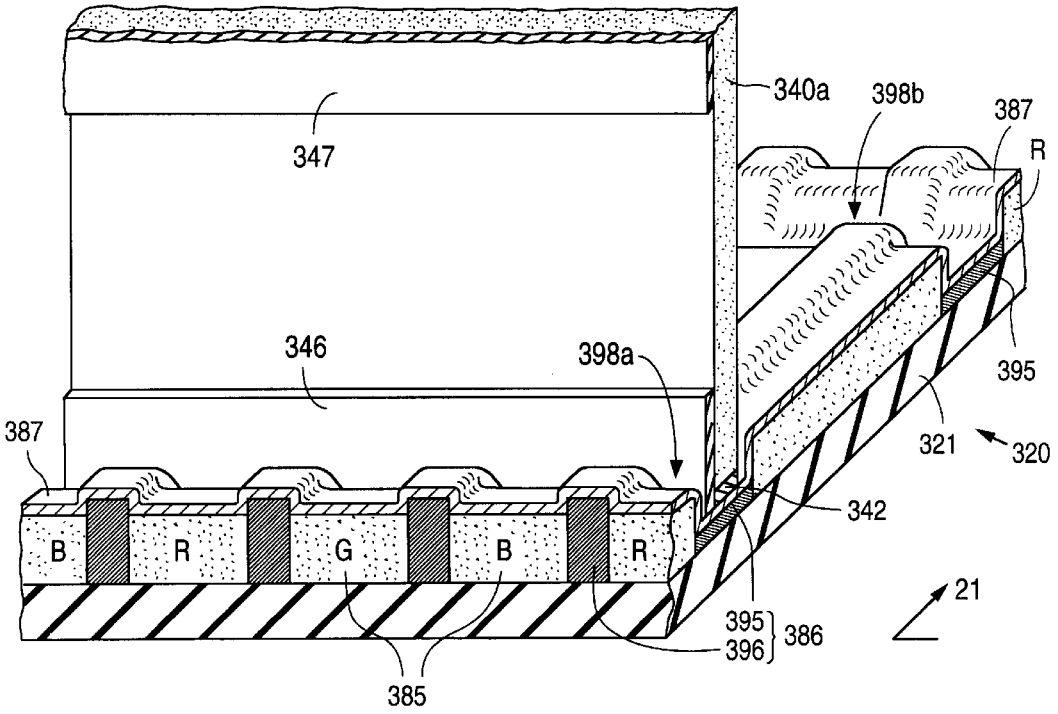
Fig. 20b

STRUCTURE AND FABRICATION OF FLAT PANEL DISPLAY WITH SPECIALLY ARRANGED SPACER

CROSS REFERENCE TO RELATED APPLICATION

This is a continuation-in-part of U.S. patent application Ser. No. 08/684,270, filed Jul. 17, 1996, now U.S. Pat. No. 5,859,502. To the extent not repeated herein, the contents of Ser. No. 08/684,270 are incorporated herein by reference.

FIELD OF THE INVENTION

The present invention relates to the arrangement of one or more spacers between a faceplate structure and a backplate structure of a flat panel display of the cathode-ray tube (CRT) type.

BACKGROUND OF THE INVENTION

A flat panel CRT display is a thin, flat display which presents an image on the display's viewing surface in response to electrons striking light emissive material. The electrons can be generated by mechanisms such as field emission and thermionic emission. A flat panel CRT display typically includes a faceplate structure and a backplate structure joined together by an outer wall along the periphery of the two plate structures. The resulting enclosure is usually held at a high vacuum, typically a pressure of $10^{-7}$ torr or less. To prevent collapse of the display under the high vacuum, one or more spacers are typically located between the plate structures.

FIG. 1 schematically illustrates a portion of a conventional flat panel CRT display 100. The components of display 100 include faceplate structure 120, backplate structure 130, spacer wall 140, and voltage source 150. Although only one spacer wall 140 is shown in FIG. 1, display 100 includes additional such spacer walls.

Faceplate structure 120 includes transparent electrically insulating faceplate 121 and light emitting structure 122 formed on the interior surface of faceplate 121. Light emitting structure 122 typically includes light emissive elements, such as phosphors, which define the active region of display 100. Faceplate structure 120 also includes an anode (not shown) adjoining light emitting structure 122 and connected to the positive (high voltage) side of voltage source 150. Backplate structure 130 consists of electrically insulating backplate 131 and electron emitting structure 132 located on the interior surface of backplate 131. Electron emitting structure 132 includes a plurality of sets 161–165 of electron emitting elements which are selectively excited to emit electrons.

Various voltages are applied to the portions of electron emitting structure 132 during display operation. All of these voltages are normally very low compared to the voltage that the positive side of voltage source 150 provides to the display's anode in faceplate structure 120. As an approximation relative to light emitting structure 122 and the adjoining anode, electron emitting structure 132 can be viewed as connected to the negative (low voltage) side of voltage source 150. FIG. 1 schematically illustrates this connection. With the anode being held at a high positive voltage (e.g., 5 kV) relative to electron emitting structure 132, the electrons emitted by the electron emitting elements in sets 161–165 impinge on corresponding light emissive elements in the light emitting structure 122, causing the light emissive elements to emit light visible at the exterior viewing surface of faceplate 121.

Spacer wall 140 is situated between the generally planar lower surface of light emitting structure 122 and the generally planar upper surface of electron emitting structure 132. With spacer 140 being made of material having a largely uniform resistivity, the electric potential field (sometimes termed voltage distribution) along spacer 140 is approximately the same as the potential field that would be present at the same location in free space, i.e., in the absence of spacer 140, between plate structures 120 and 130. Except for electrons that strike spacer 140, the presence of spacer 140 does not significantly affect the movement of electrons from electron emitting structure 132 to light emitting structure 122.

FIG. 2 schematically depicts a portion of another conventional flat panel CRT display 200. Except as described below, displays 100 and 200 are the same, similar elements being labeled with the same reference symbols. Baseplate structure 130 of display 200 additionally includes electron focusing system 133 consisting of focusing structures 133*a*–133*f*. One edge of spacer wall 140 contacts focusing structure 133*a*.The opposite edge of spacer 140 contacts light emitting structure 122.

Focusing system 133 is electrically connected to the negative side of voltage source 150. As a result, focusing system 133 asserts repulsive forces on the electrons emitted from the electron emitting elements in sets 161–165. These repulsive forces direct or focus electrons toward the appropriate light emitting elements of light emitting structure 122.

With focusing system 133, specifically focusing structure 133*a*, being at the same potential as electron emitting structure 132, the potential field along spacer wall 140 is different from the potential field that would be present at the same location in free space, i.e., again in the absence of spacer 140, between faceplate structure 120 and baseplate structure 130, now including focusing system 133. This can result in undesired deflection of electrons emitted from electron emitting elements close to spacer 140, e.g., the electron emitting elements in sets 161 and 162. It is desirable to arrange a spacer in a flat panel CRT display containing an electron focusing system so as to avoid undesirable electron deflection or to overcome undesired electron deflection that does occur.

GENERAL DISCLOSURE OF THE INVENTION

The present invention addresses the foregoing electron deflection concerns according to two basic approaches.

In one of the approaches, the electric potential field along a spacer situated between a backplate structure and a faceplate structure of a flat panel display is controlled so as to approximate the potential field that would be present at the same location in free space, i.e., in the absence of the spacer, between the two plate structures even though a non-planar approximately equipotential surface is present at one or more major locations in the display. As a result, the presence of the spacer does not significantly affect the trajectories of electrons moving from the backplate structure to the faceplate structure. The spacer is, to a substantial degree, electrically transparent to the electron flow. Undesired electron deflection is largely avoided.

More particularly, a flat panel display configured in accordance with the invention contains a backplate structure, a faceplate structure, and a spacer. In one aspect of the deflection-avoidance approach, the components of the backplate structure include a backplate, an electron emitting structure, and a primary structure. The electron emitting structure overlies the backplate and has electron-emission sites situated generally in an emission-site plane. The primary structure, typically a focusing system for focusing electrons emitted by the electron emitting structure, likewise overlies the backplate.

The primary structure has a non-planar approximately equipotential surface situated generally along the emission-site plane. The distance from the emission-site plane to the non-planar approximately equipotential surface varies between first and second values.

The backplate structure has an electrical end located in an electrical-end plane extending generally parallel to the emission-site plane. The distance from the emission-site plane to the electrical-end plane for the backplate structure lies between the first and second values. The electrical nature of the electrical-end plane is that the capacitance between the faceplate structure and an (imaginary) electrically conductive plate situated at the electrical-end plane in a spacer-free region (i.e., a region having no spacer) extending along the primary structure typically approximately equals the capacitance between the faceplate structure and the backplate structure, including the primary structure, in the spacer-free region.

The faceplate structure is coupled to the backplate structure to form a sealed enclosure. The spacer is situated between the two plate structures for resisting external forces exerted on the display. In particular, the spacer is normally situated between the primary structure and the faceplate structure.

Importantly, the spacer has a backplate-side electrical end located approximately in the electrical-end plane for the backplate structure. With the spacer situated between the primary and faceplate structures, the spacer's backplate-side electrical end is thus approximately coincident with the electrical end of the backplate structure. The coincidence is typically achieved by having the spacer extend into a recessed space in the primary structure. Due to this coincidence, the potential field along the spacer near the backplate structure is approximately the same as the potential field that would exist at the same location in free space between the two plate structures. Accordingly, the presence of the spacer does not cause the electron trajectories to be significantly different from what they would be in the absence of the spacer.

The arrangement of the spacer with respect to the faceplate structure can be handled in a similar way to how the spacer is arranged with respect to the backplate structure. In another aspect of the deflection-avoidance approach, the components of the faceplate structure include a faceplate, a light emitting structure, and a main structure. The faceplate has an interior surface situated largely in a faceplate plane. The light emitting structure overlies the faceplate along its interior surface. The main structure, typically an anode for attracting electrons emitted by the backplate structure, likewise overlies the faceplate along its interior surface.

Similar to the primary structure in the first-mentioned aspect of the deflection-avoidance approach, the main structure has a non-planar approximately equipotential surface situated over the faceplate plane. The distance from the faceplate plane to this further non-planar approximately equipotential surface varies between further first and second values.

The faceplate structure has an electrical end located in a further electrical-end plane overlying, and extending generally parallel to, the faceplate plane. The distance from the faceplate plane to the electrical-end plane for the faceplate structure lies between the further first and second values. The electrical nature of the electrical-end plane in this aspect of the deflection-avoidance approach is that the capacitance between the backplate structure and an (imaginary) electrically conductive plate situated at the electrical-end plane in a spacer-free region extending along the main structure typically approximately equals the capacitance between the backplate structure and the faceplate structure, including the main structure, in the spacer-free region.

The spacer in this second aspect of the deflection-avoidance approach has a faceplate-side electrical end located approximately in the electrical-end plane for the faceplate structure. The spacer is normally situated between the main and backplate structures. Accordingly, the spacer's faceplate-side electrical end is approximately coincident with the electrical end of the faceplate structure. The coincidence of these two electrical ends is normally accomplished by arranging for the spacer to extend into a recessed space in the main structure. As a result of this coincidence, the potential field along the spacer near the faceplate structure is approximately the same as the potential field that would exist at the same location in free space between the two plate structures.

In the other approach to solving the electron-deflection problem, a spacer situated between a backplate structure and a faceplate structure of a flat panel display is arranged to produce electron deflection that largely compensates for undesired electron deflection which occurs earlier during electron travel from the backplate structure to the faceplate structure. The net electron deflection is small, relatively close to zero. The backplate structure in the deflection-compensation approach contains a backplate, an electron emitting structure, and a primary structure configured as described above in the first aspect of the deflection-avoidance approach. The spacer in the deflection-compensation approach is again normally situated between the primary and faceplate structures.

The spacer in the deflection-compensation approach has a backplate-side electrical end situated along the primary structure at a location spaced apart from the electrical-end plane for the backplate structure. In particular, the spacer's backplate-side electrical end typically overlies the electrical-end plane for the backplate structure and thus is further away from the emission-site plane than the electrical end of the backplate structure. The spacer is provided with compensation structure for controlling the potential field along the spacer so that electrons emitted by the electron emitting structure strike target areas on the faceplate structure rather than striking outside the target areas due to the spacer's backplate-side electrical end being spaced apart from the electrical-end plane for the backplate structure. The compensation structure is normally spaced apart from the spacer's backplate-side electrical end.

In the deflection-compensation approach, a face electrode that forms at least part of the compensation structure is typically situated along a face surface of a main spacer portion of the spacer. The face electrode can extend largely to the spacer's faceplate-side electrical end. Alternatively, the face electrode can be situated between the two electrical ends of the spacer. Locating the face electrode in either of these two generally different positions enables the potential field along the spacer near the face electrode to be modified in such a way as to produce electron deflection which compensates for undesired earlier electron deflection that results from the spacer's backplate-side electrical end being located above the electrical-end plane for the backplate structure.

The corrective electron deflection caused by the spacer's compensation structure may sometimes be insufficient to fully compensate for the undesired earlier electron deflection. If so, further compensation can be achieved by appropriately positioning the spacer with respect to the faceplate structure. Specifically, the faceplate structure is again provided with the main structure described above. The spacer's faceplate-side electrical end is arranged to be spaced apart from the electrical-end plane for the faceplate structure in a way that assists the compensation structure in controlling the potential field along the spacer so as to produce a composite electron deflection that largely cancels the initial undesired electron deflection. Normally, the spacer's faceplate-side electrical end overlies the electrical-end plane for the faceplate structure and thus is further away from the faceplate plane than the electrical end of the faceplate structure.

The present invention also furnishes techniques for manufacturing a flat panel display having a spacer arranged to largely avoid undesired electron deflection or to modify the local potential field so as to compensate for undesired electron deflection. In short, the invention enables electrons emitted by the electron emitting structure to accurately strike intended target areas in the faceplate structure. The invention thus provides a large advance over the prior art.

BRIEF DESCRIPTION OF THE DRAWINGS

FIGS. 18*a* and 18*b* are perspective views of a portion of a faceplate structure for a flat panel CRT display in accordance with the invention before and after mounting a spacer in the display.

FIG. 19 is a cross-sectional view of the faceplate structure in FIG. 18*b*.

FIGS. 20*a* and 20*b* are perspective views of a portion of another faceplate structure for a flat panel CRT display in accordance with the invention before and after mounting a spacer in the display.

DESCRIPTION OF THE PREFERRED EMBODIMENTS

Figure 1:
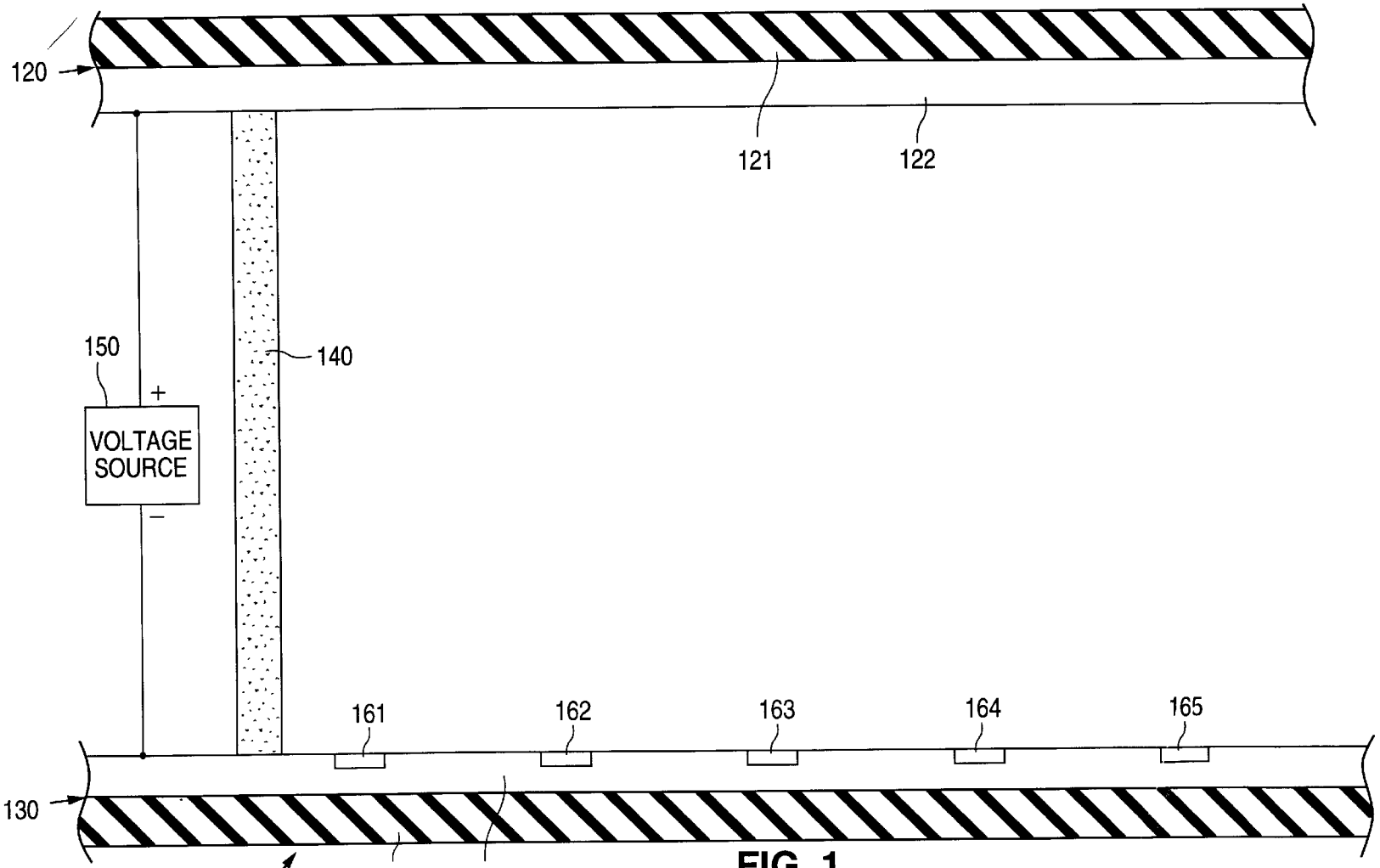
FIG. 1 PRIOR ART
FIGS. 1 and 2 are schematic cross-sectional views of portions of conventional flat panel CRT displays.
Figure 2:
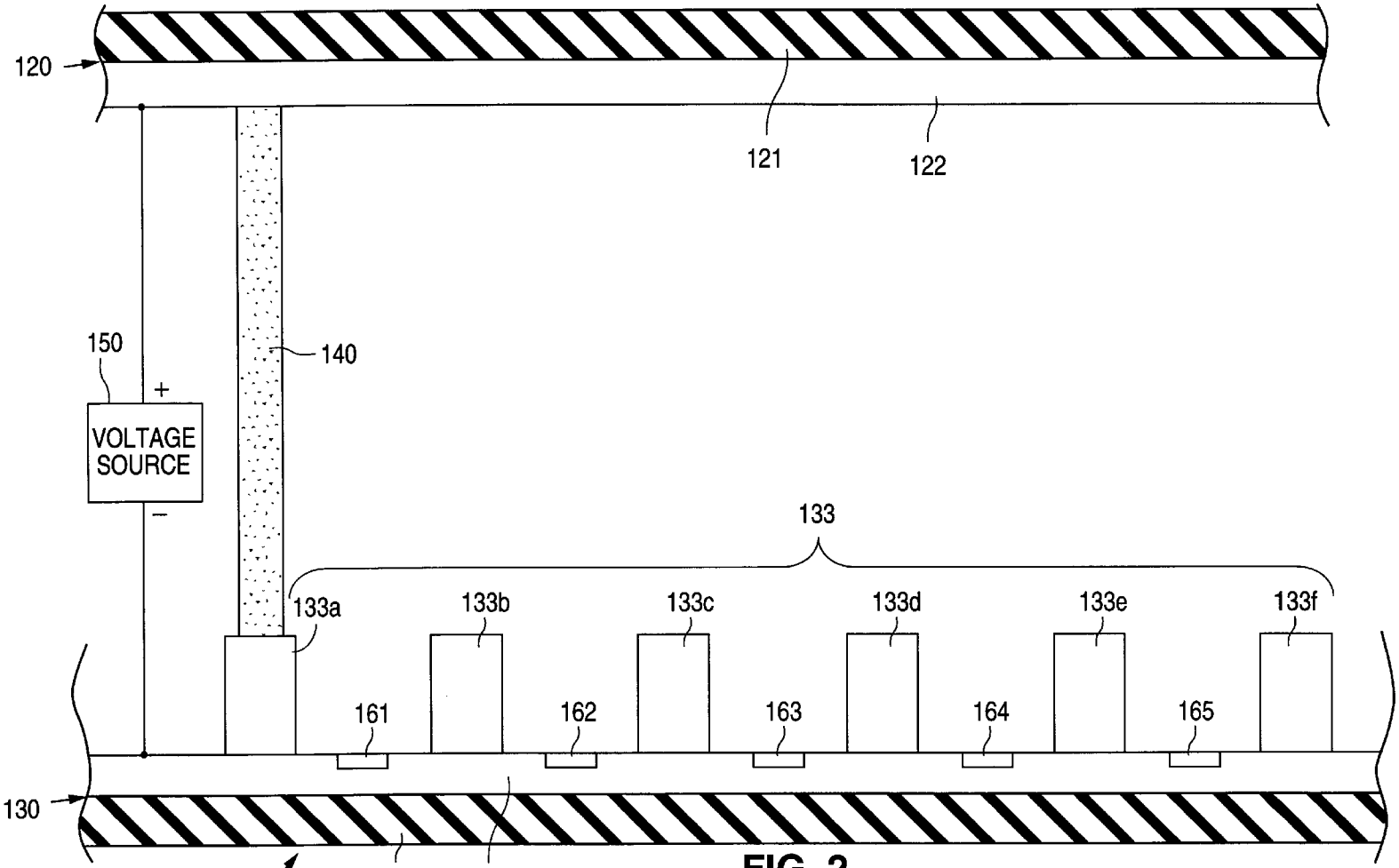
FIG. 2 PRIOR ART

In the following description, the term "electrically insulating" (or "dielectric") generally applies to materials having a resistivity greater than $10^{12}$ ohm-cm. The term "electrically non-insulating" thus refers to materials having a resistivity below $10^{12}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{12}$ ohm-cm. Similarly, the term "electrically non-conductive" refers to materials having a resistivity greater than 1 ohm-cm and includes electrically insulating and electrically resistive materials. These categories are determined at an electric field of no more than 10 volts/$\mu$m.

Each electrically non-insulating electrode described below has a resistivity of no more than $10^5$ ohm-cm. Accordingly, electrically non-insulating electrodes can be formed with electrically conductive materials or/and electrically resistive materials of resistivity between 1 and $10^5$ ohm-cm. The resistivity of each electrically non-insulating electrode is normally no more than $10^3$ ohm-cm.

Examples of electrically conductive materials (or electrical conductors) are metals, metal-semiconductor compounds, and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles), other such metal-insulator composites, electrically resistive ceramics, and filled glasses.

A spacer situated between a backplate structure and a faceplate structure of a flat panel CRT display as described below typically consists of (a) a main spacer portion, (b) a pair of edge electrodes that respectively contact the backplate and faceplate structures, and (c) possibly one or more face electrodes. The edge electrodes extend along opposite edges (or edge surfaces) of the main spacer portion. Each face electrode extends along a face surface of the main spacer portion. A face electrode may contact an edge electrode.

The spacer has two electrical ends, referred to here generally as the backplate-side and faceplate-side electrical ends, located in the immediate vicinities of where the edge electrodes respectively contact the backplate and faceplate structures. The positions of the spacer's two electrical ends relative to the physical ends of the spacer at the two edge electrodes are determined in the following manner.

When each, if any, face electrode is spaced apart from an edge electrode that extends along the entire edge of the main spacer portion, the corresponding electrical end of the spacer occurs at that edge electrode and therefore coincides with the corresponding physical end of the spacer. When a face electrode contacts an edge electrode again extending along the entire edge of the main spacer portion, the corresponding electrical end of the spacer is moved up the spacer toward the other edge electrode by a resistively determined amount. Specifically, the spacer (including both edge electrodes and the face electrode) has a resistance approximately equal to that of a shorter spacer which has both edge electrodes but lacks the face electrode. The difference in length between the two spacers, i.e., the one having the face electrode and the shorter one lacking the face electrode, is the distance which the indicated electrical end of the spacer having the face electrode moves up that spacer away from the corresponding physical end. When two or more face electrodes contact an edge electrode extending along the entire edge of the main spacer portion, the electrical end of the spacer is moved up the spacer by a similarly calculated amount.

When an edge electrode extends along only part of the edge of the main spacer portion and when each, if any, face electrode is spaced apart from that edge electrode, the corresponding electrical end of the spacer is moved beyond the physical end of the spacer by a resistively determined amount. When a face electrode contacts an edge electrode that extends along only part of the edge of the main spacer portion, the corresponding electrical end of the spacer is either moved up the spacer toward the other edge electrode, or beyond the spacer, by a resistively determined amount depending on various factors. The distance by which the electrical and physical ends of the spacer differ in these two cases is determined according to the technique described in the previous paragraph.

In certain embodiments of the invention, a spacer is described as being electrically transparent to the movement of electrons from the backplate structure to the faceplate structure. As so used, "electrically transparent" means that the potential field along the spacer is approximately the same as the potential field that would be present in the absence of the spacer and in the absence of surface modification, such as a groove, made to accommodate the spacer. As used here, electrode potentials are surface potentials, including work functions, rather than voltage supply potentials.

Figure 3:
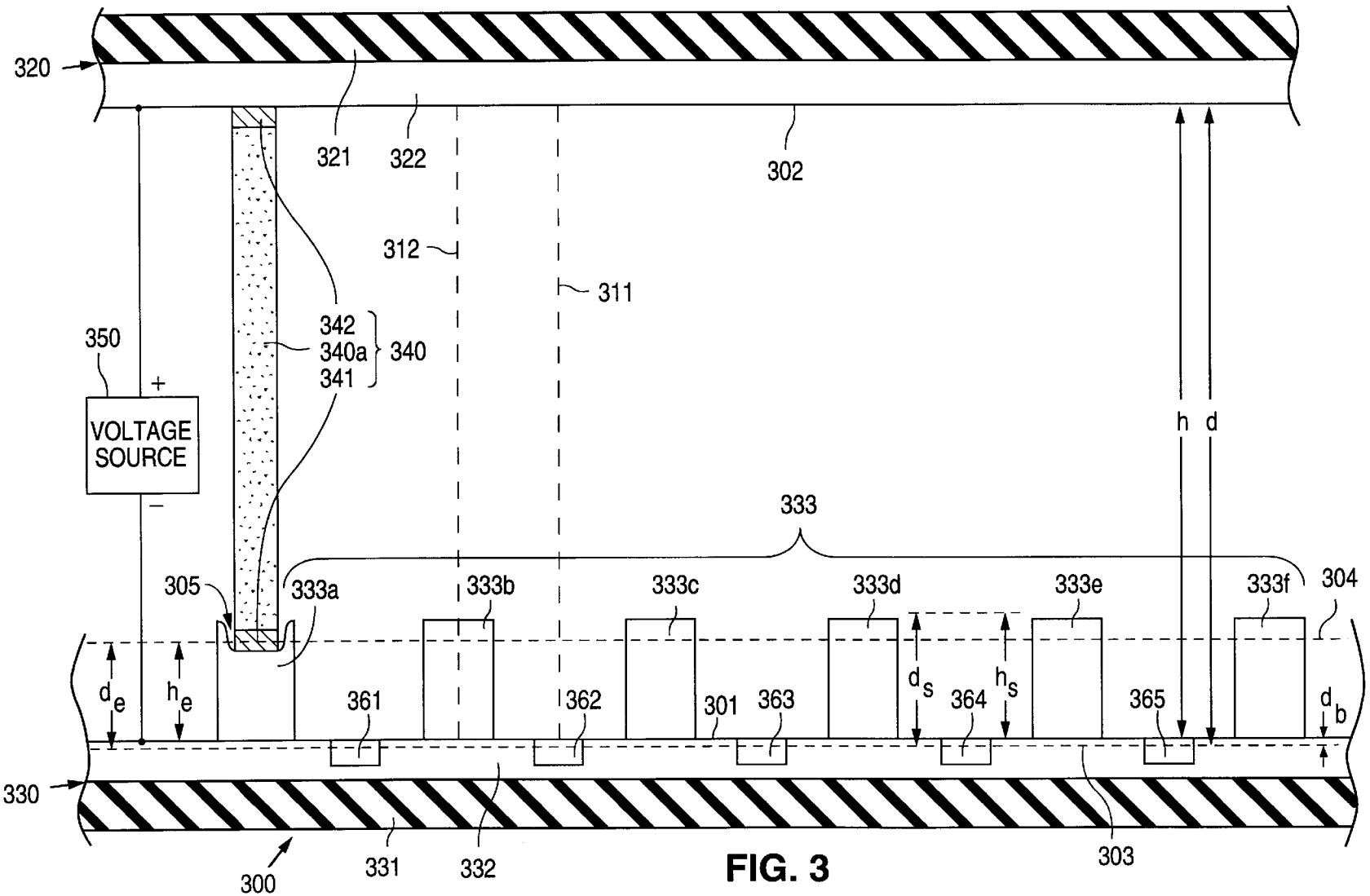
FIG. 3 is a schematic cross-sectional view of a portion of a flat panel CRT display in accordance with the invention.

FIG. 3 illustrates a portion of a flat panel CRT display 300 in accordance with the invention. Display 300 includes a faceplate structure 320, a backplate structure 330, a spacer 340, a voltage source 350, and an outer wall (not shown). Although only one spacer 340 is shown in FIG. 3, display 300 normally includes similar additional spacers. Voltage source 350 is a general power supply that furnishes various voltages (and currents), including a high voltage used in part of faceplate structure 320. In addition to the taps shown in FIG. 3, voltage source 350 may have one or more other taps (not shown) for providing one or more further voltages (or currents) used in display 300.

Faceplate structure 320 is formed with a transparent electrically insulating faceplate 321, typically glass, and a light emitting structure 322 situated on the interior surface of faceplate 321. Light emitting structure 322, which contains light emissive material (not shown), has an interior surface 302. Faceplate structure 320 further includes an anode (also not shown) connected to the positive (high voltage) side of voltage source 350 so as to be held at a high voltage typically in the range of 4 to 10 kV. Faceplate structure 320 is described further in U.S. Pat. No. 5,477,105, hereby incorporated by reference.

Backplate structure 330 consists of an electrically insulating backplate 331, an electron emitting structure 332, and a primary structure 333. Electron emitting structure 332, situated on the interior surface of backplate 321, includes a plurality of laterally separated sets 361–365 of electron emitting elements which are selectively excited to emit electrons. The electron emitting elements in sets 361–365 can, for example, be filamentary field emitters or conical field emitters.

Similar to what occurs with electron emitting structure 132 in prior art flat panel CRT display 100 or 200 described above, various voltages are applied to the portions of electron emitting structure 332 during operation of flat panel display 300. These voltages are all low compared to the voltage applied by the positive side of voltage source 350 to the display's anode. As an approximation relative to light-emitting structure 322 and the adjoining anode, electron emitting structure 332 can be viewed as connected to the negative (low voltage) side of voltage source 350. FIG. 3 schematically illustrates this connection. As a result, electron emitting structure 322 is at approximately 0 volt. With the anode being at a high positive voltage (e.g., 5 kV) relative to the electron emitting structure 332, electrons released by the electron emitting elements in sets 361–365 are accelerated toward corresponding light emissive elements in light emitting structure 322. Backplate structure 330 is described further in U.S. Pat. No. 5,686,790 and PCT Publication WO 95/07543, both incorporated by reference herein.

Primary structure 333 here is an electron focusing system consisting of focusing structures 333*a*–333*f* located on the upper surface 301 of electron emitting structure 322. Each of focusing structures 333*a*–333*f* can be a separate structure that extends along the length of flat panel display 300. Alternatively, focusing structures 333*a*–333*f* can form a focusing grid which includes cross members not shown in FIG. 3. Such focusing structures are described further in U.S. Pat. Nos. 5,528,103 and 5,650,690, both incorporated by reference herein. In either case, focusing structures 333*a*–333*f*, are connected to the negative side of voltage source 350 and are therefore at approximately 0volt in the example of FIG. 3.

Spacer 340 is situated between light emitting structure 322 and focusing structure 333*a*. Other such spacers are similarly situated between light emitting structure 322, on one hand, and selected ones of the other focusing structures such as focusing structures 333*b*–333*f*, on the other hand, provided that at least one focusing structure not contacting a spacer lies between each consecutive pair of focusing structures contacting spacers. For example, another spacer could contact focusing structure 333*c* but not focusing structure 333*b*. In a typical implementation, a spacer contacts every thirtieth focusing structure in focusing system 333.

Spacer 340 consists of a main spacer portion 340*a* and a pair of electrically non-insulating edge electrodes 341 and 342 located at opposite edges of main spacer portion 340*a*. Edge electrodes 341 and 342 preferably consist of electrically conductive material, typically metal. Main spacer portion 340*a* can be shaped as a wall, a partial wall, a post, a cross, or a tee. FIG. 3 presents the exemplary situation in which spacer portion 340*a* is wall. Portion 340*a* typically consists of material having a largely uniform resistivity.

Edge electrode 341 contacts focusing structure 333*a*. Edge electrode 342 contacts light emitting structure 322. Edge electrodes 341 and 342 are typically metal. Spacer 340, including edge electrodes 341 and 342, is described further in U.S. Pat. Nos. 5,675,212 and 5,614,781, both incorporated by reference herein. In flat panel display 300, edge electrodes 341 and 342 form opposite electrical ends, referred to here respectively as the backplate-side and faceplate-side electrical ends, of spacer 340.

Spacer 340 is positioned in a groove (recessed space) 305 located in focusing structure 333*a*. Groove 305 typically has a depth of 2–15 $\mu$m. Backplate-side edge electrode 341 contacts focusing structure 333*a* within groove 305. The relatively high electrical conductance of edge electrode 341 causes the potential along the surface portion of focusing structure 333*a* at the bottom of groove 305 to be largely equal to the potential at the bottom edge of spacer 340. The depth of groove 305 is selected to make spacer 340 electrically "disappear". That is, the depth of groove 305 is selected such that the potential field along spacer 340 is close to the potential field that would exist at the same location in free space, i.e., in the absence of spacer 340, between faceplate structure 320 and backplate structure 330, including focusing system 333.

Figure 4:
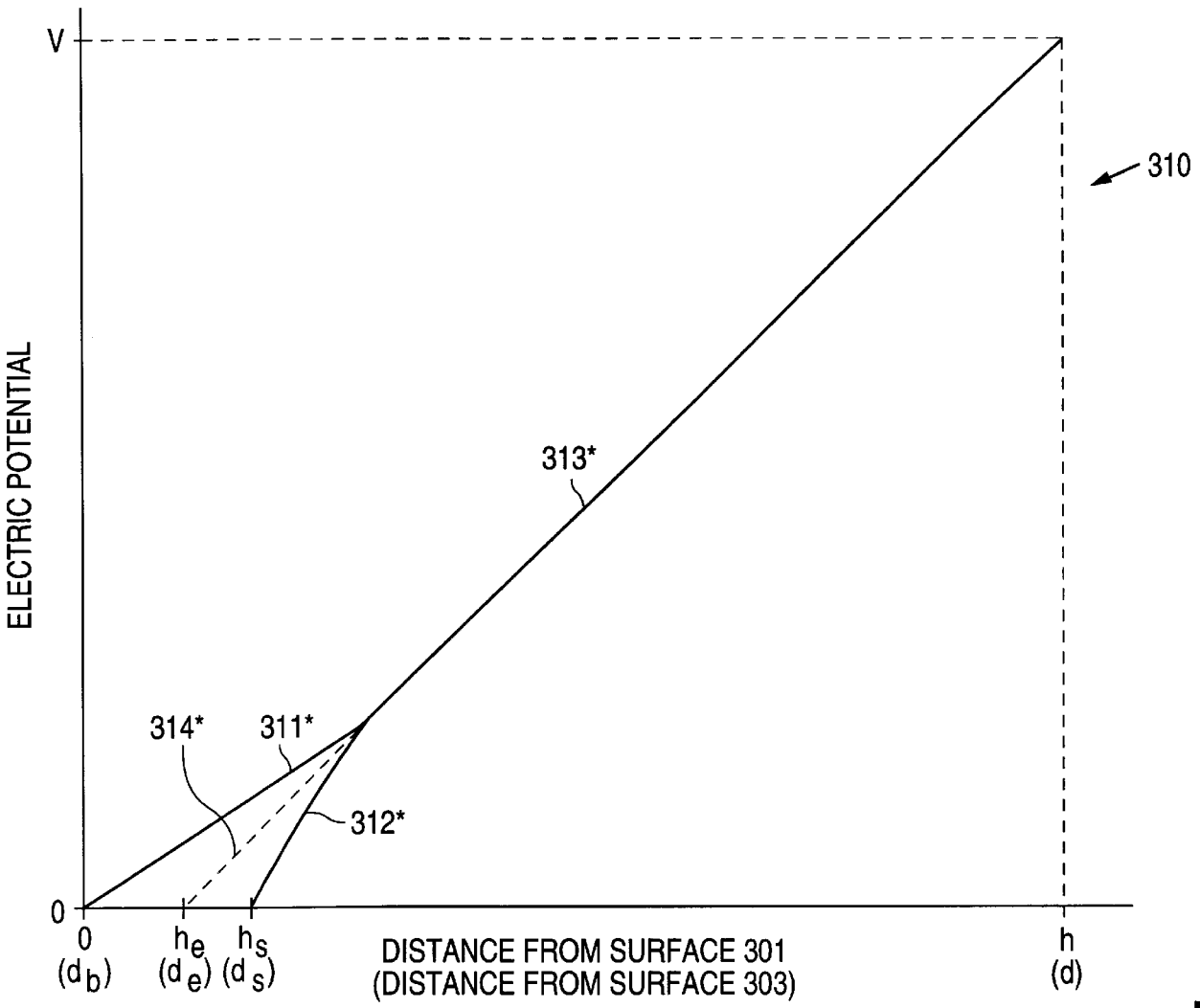
FIG. 4 is a graph of electric potential as a function of height at various locations in the flat panel display of FIG. 3.

FIG. 4 is a graph 310 used to determine the approximate depth of groove 305 for flat panel display 300. The vertical coordinate of graph 310 presents the electric potential inside display 300 for the representative average situation in which the potential along the exposed portions of surface 301 of electron emitting structure 332 is zero. With focusing system 333 being at zero potential, the potential within display 300 varies from zero at electron emitting structure 332 and focusing system 333 up to V at the display's anode in faceplate structure 320. The horizontal coordinate of graph 310 presents the height measured from surface 301. This height varies from zero at surface 301 up to h at surface 302 of light emitting structure 322 along the anode. In this regard, surface 302 is considered to be substantially coincident with the anode.

Curve 311* in graph 310 roughly illustrates the potential along line 311 of FIG. 3. As depicted in FIG. 3, line 311 extends from surface 301 of electron emitting structure 332 to surface 302 of light emitting structure 322. Curve 311* shows that the potential at surface 301 along line 311 is zero, and that the potential at height h along line 311 is V.

Curve 312* in graph 310 roughly illustrates the potential along line 312 of FIG. 3. As depicted in FIG. 3, line 312 extends from the top of focusing structure 333*b* to surface 302 of light emitting structure 322. The top surface of each of focusing structures 333*b*–333*f* is located at a height $h_s$ above surface 301. Height $h_s$ is 20–70 μm, typically 40–50 μm. Curve 312* shows that the potential at height $h_s$ along line 312 is zero, and that the potential at height h along line 312 is V. Focusing structures 333*c*–333*f* exhibit approximately the same local potential fields as focusing structure 333*b*.

As FIG. 4 shows, curves 311* and 312* converge to a straight common line 313*. Common line 313* has a slope greater than the average slope of curve 311* and less than the average slope of curve 312*. Dashed line 314* illustrates the extrapolation of straight common line 313* to the horizontal axis of graph 310. Dashed line 314* intersects the horizontal axis of graph 310 at a height $h_e$ above surface 301. Height $h_e$ defines the electrical end of backplate structure 330, including focusing system 333.

Common line 313* and dashed line 314* represent the average potential field in free space between faceplate structure 320 and backplate structure 330, including focusing system 333. Approximately the same potential field would be provided by an electrically conductive planar electrode (a) held at zero potential, (b) situated in parallel with surfaces 301 and 302 in a region of display 300 encompassing at least one of focusing structures 333*b*–333*f* but having no spacers, and (c) located at height h*e*.

In this regard, the capacitance between faceplate structure 320 and an imaginary electrically conductive (e.g., metal) plate located at height $h_e$ in a region of display 300 encompassing at least one of focusing structures 333*b*–333*f* but having no spacers is typically approximately equal to the capacitance between faceplate structure 320 and backplate structure 330, including focusing system 333, in the indicated spacer-free region of display 300. This is why height $h_e$ defines the electrical end of backplate structure 330. Assuming that no spacers contact focusing structures 333*b*–333*e*, the spacer-free region of display 300 for purpose of this capacitance equality can, for example, be the region extending along focusing system 333 (a) from a vertical plane situated equidistant between focusing structures 333*a* and 333*b* to (b) a vertical plane situated equidistant between focusing structures 333*e* and 333*f*.

To make spacer 340 electrically disappear in the potential field present in the interior of flat panel display 300, the potential field along spacer 340 must be approximately the same as the potential field that would exist at the same location in free space between faceplate structure 320 and backplate structure 330, including focusing system 333. Achieving this condition entails choosing groove 305 to be of such depth that edge electrode 341 at the backplate-side electrical end of spacer 340 is positioned largely at the electrical end of backplate structure 330. That is, edge electrode 341 is positioned largely at height $h_e$ so that the backplate-side electrical end of spacer 340 is largely coincident with the electrical end of backplate structure 330. In this manner, edge electrode 341 causes the bottom edge of spacer 340 to be largely at zero potential at height $h_e$. The depth of groove 305 is approximately $h_s$-$h_e$ here. The top edge of spacer 340 is maintained at potential V by faceplate-side edge electrode 342 which contacts the anode.

With the resistivity of main spacer portion 340*a* being largely uniform, the potential field along spacer 340 varies in an approximately linear manner from zero at height $h_e$ up to V at height h. The potential field along spacer portion 340*a* therefore largely matches the potential field that would exist in free space between plate structures 320 and 330. The identity (sameness) of these potential fields along most of spacer 340 prevents undesired deflection of electrons emitted from electron emitting elements, such as those in set 361, near spacer 340. The degree to which spacer 340 is electrically transparent to the electron flow generally increases as the backplate-side electrical end of spacer 340 become closer to coincident with the electrical end of backplate structure 330.

Figure 5:
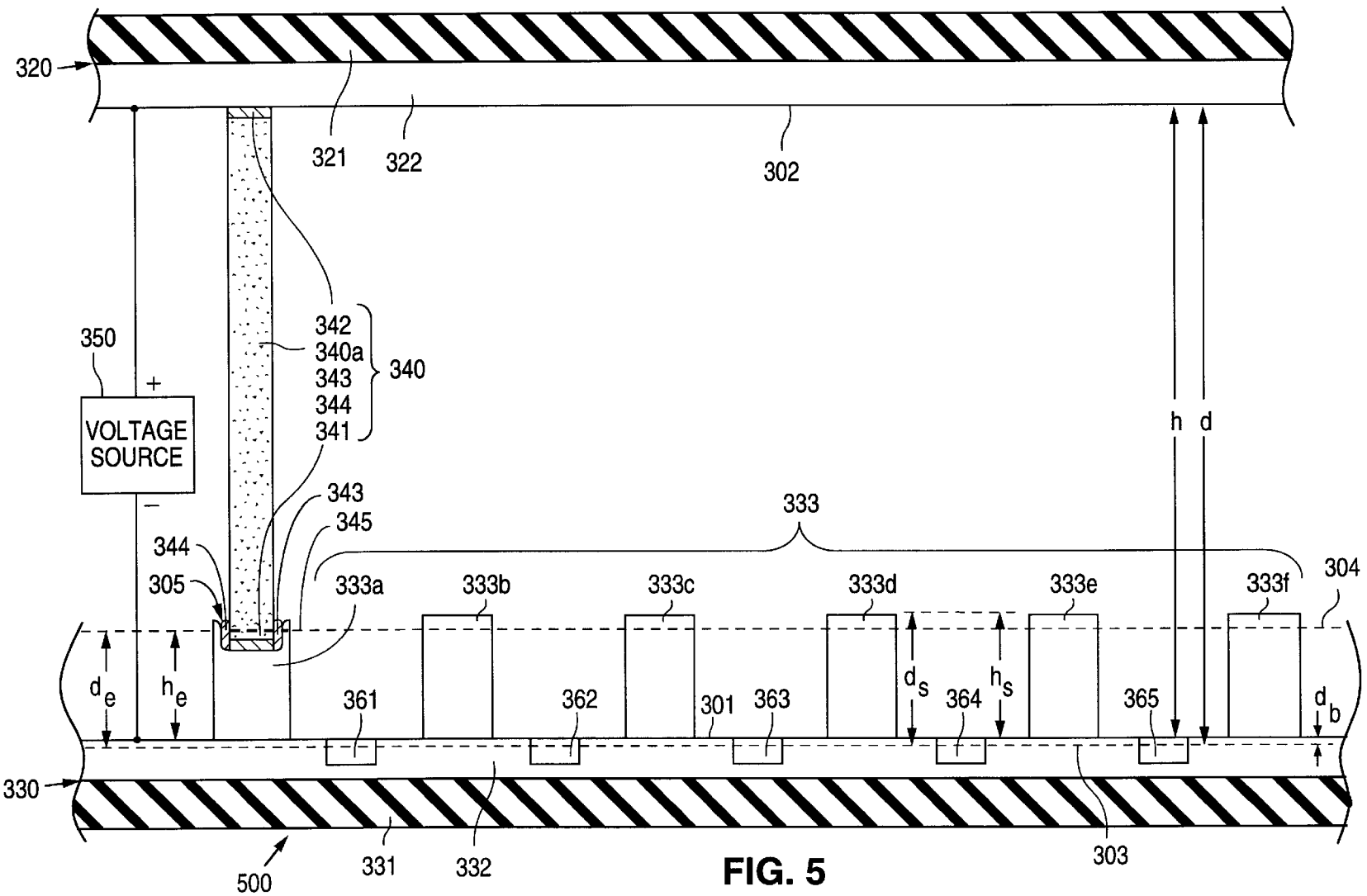
FIGS. 5–7 are schematic cross-sectional views of portions of flat panel CRT displays which utilize spacers having face electrodes in accordance with the invention.

FIG. 5 schematically illustrates a portion of a flat panel CRT display 500 in accordance with a variation of the embodiment of FIG. 3. Because display 500 is similar to display 300, similar elements in FIGS. 3 and 5 are labeled with the same reference symbols. In display 500, spacer 340 is modified to include electrically non-insulating face electrodes 343 and 344. Face electrodes 343 and 344 preferably consist of electrically conductive material, typically metal. As shown in FIG. 5, face electrodes 343 and 344 contact edge electrode 341 and extend partially over opposite face surfaces of main spacer portion 340*a*. The fabrication of face electrodes 343 and 344 is described further in Schmid et al, U.S. patent application Ser. No. 08/414,408 now U.S. Pat. No. 5,675,212, and Spindt et al, U.S. patent application Ser. No. 08/505,841 now U.S. Pat. No. 5,614,781, both incorporated by reference herein.

Face electrodes 343 and 344 modify the electrical properties of spacer wall 340 such that the backplate-side electrical end of spacer 340 no longer coincides with backplate-side edge electrode 341. Face electrodes 343 and 344 result in the backplate-side electrical end of spacer 340 being moved up spacer 340 to a spacer backplate-side electrical end plane 345. That is, spacer 340, including edge electrode 341 and face electrodes 343 and 344, has a resistance equal to the resistance exhibited by a slightly shorter spacer having an electrically conductive backplate-side edge surface, i.e., an electrically conductive backplate-side edge electrode, at electrical-end plane 345 but no face electrode(s) at electrical-end plane 345.

As illustrated in FIG. 5, the depth of groove 305 in display 500 is slightly deeper than the depth of groove 305 in display 300 of FIG. 3. The depth of groove 305 in display 500 is chosen such that spacer electrical end plane 345 largely coincides with the electrical end of backplate structure 330 at height $h_e$. That is, the backplate-side electrical end of spacer 340 and the electrical end of backplate structure 330 are largely coincident. By locating spacer electrical-end plane 345 in this manner, the potential field along most of spacer 340 in display 500 approximates the potential field that would exist at the same location in free space between faceplate structure 320 and backplate structure 330, again including focusing system 333.

Although FIG. 5 illustrates two face electrodes 343 and 344, the same result can be obtained by using only one of face electrodes 343 or 344. The use of one face electrode 343 or 344 can reduce the number of processing steps (and therefore processing costs) associated with fabricating spacer 340.

The electrical-end matching procedure for flat panel display 300 or 500 can be explained from a somewhat different perspective that facilitates generalizing the electrical-end matching procedure. Referring to FIG. 3 or 5, the electron emitting elements in sets 361–365 emit electrons from electron-emission sites situated generally in an emission-site plane 303 located at a distance (or height) $d_b$ below surface 301 of electron emitting structure 332. In the example of FIG. 3 or 5 where the negative side of voltage source 350 is represented as being connected to electron emitting structure 332 along surface 301, a backplate-side non-planar approximately equipotential surface runs along the outside of focusing system 333 down to surface 301. Hence, distance $d_b$ also represents the distance from emission-site plane 303 to the closest portions of the non-planar approximately equipotential surface of focusing system 333.

Along its outside surface, focusing system 333 consists of electrically conductive material that forms the backplate-side non-planar approximately equipotential surface. Inasmuch as this conductive material has some finite, though small, resistance, the potential along the outside of focusing system 333 can vary slightly from point to point. However, the variation is insignificant insofar as the present invention is concerned. For this reason, the non-planar approximately equipotential surface along the outside of focusing system 333 is often referred to below simply as a non-planar equipotential surface, i.e., without using the qualifier "approximately". The same applies to other such non-planar approximately equipotential surfaces described below.

The top surface of focusing system 333 is at a distance (or height) $d_s$ above emission-site plane 303. The non-planar equipotential surface of focusing system 333 thus extends above emission-site plane 303 to a distance (or height) varying from $d_b$ to $d_s$. Distance $d_s$ equals $h_s+d_b$ in the example of FIG. 3 or 5. Distance $d_b$ is typically on the order of 0.1 $\mu$m. Inasmuch as height $h_s$ is 20–70 $\mu$m, typically 40–50 $\mu$m, distance $d_b$ is quite small compared to height $h_s$. Consequently, distance $d_s$ is approximately 20–70 $\mu$m, typically 40–50 $\mu$m.

The electrical end of backplate structure 330 in flat panel display 300 or 500 is located in a backplate-side electrical-end plane 304 extending largely parallel to emission-site plane 303 at a distance (or height) $d_e$ above emission-site plane 303. Distance $d_e$ equals $h_e+d_b$ in the example of FIG. 3 or 5. Since height $h_e$ lies between $h_s$ and zero, distance $d_e$ lies between $d_b$ and $d_s$.

Also, surface 302 of light emitting structure 322 is at a distance (or height) d above emission site plane 303, where distance d equals $h+d_b$. The potential field along spacer 340 can be explained in terms of distances $d_b$, $d_e$, $d_s$, and d by simply shifting the horizontal coordinate of graph 310 of FIG. 4 by an amount equal to $d_b$. This is illustrated by the parenthetical entries in FIG. 4.

As mentioned above, the various parts of electron emitting structure 332 in flat panel display 300 or 500 are low in voltage compared to the voltage applied by the positive side of voltage source 350 to the anode. However, the voltages applied to the various parts of electron emitting structure 332 actually vary during display operation and are not constant as implied by the connection of the negative side of voltage source 350 to electron emitting structure 332 in FIG. 3 or 5. The exposed portion of surface 301 of electron emitting structure 332 is thus not actually an equipotential surface.

A largely constant voltage is applied to the exposed electrically conductive surface of focusing system 333 as represented by the connection of the negative side of voltage source 350 to focusing system 333 in FIG. 3 or 5. Consequently, the exposed conductive surface of focusing system 333 is indeed a non-planar equipotential surface. Subject to decoupling the voltage applied to the exposed conductive surface of focusing system 333 from the voltages applied to the different parts of electron emitting structure 332, the potential field along spacer 340 near edge electrode 341 approximates the desired free-space potential field when the backplate-side electrical end of spacer 340 is largely located in backplate-side electrical-end plane 304 and thus is largely coincident with the electrical end of backplate structure 330. Since edge electrode 341 forms the backplate-side electrical end of spacer 340 in flat panel display 300, edge electrode 341 in display 300 lies largely in electrical-end plane 304. For flat panel display 500 in which the backplate-side end of spacer 340 is located up spacer 340 spaced apart from edge electrode 341 due to the presence of face electrodes 343 and 344, spacer electrical-end plane 345 largely coincides with backplate-side electrical-end plane 304.

In flat panel display 300 or 500 as modified to decouple the voltage applied to the exposed conductive surface of focusing system 333 from the voltages applied to the various parts of electron emitting structure 332, the exposed conductive surface of focusing system 333 may extend only partway down the sidewalls of focusing system 333. That is, a band of electrically non-conductive material, such as electrically insulating material, may extend from surface 301 partway up the sidewalls of focusing system 333 to the electrically conductive material that forms the remainder of the exposed surface of focusing system 333. Haven et al, U.S. patent application Ser. No. 08/866,554, now abandoned, and Knall et al, U.S. patent application Ser. No. 08/962,527, now allowed both incorporated by reference herein, describe examples of electron focusing systems configured in this manner. Distance $d_b$ can then represent the distance from emission-site plane 303 to the bottom of the exposed conductive surface of focusing system 333.

With the foregoing generalizations, distance $d_e$ to the backplate-side electrical end of spacer 340 still lies between $d_b$ and $d_s$. The potential field along spacer 340 near edge electrode 341 then approximates the desired free-space potential field by again arranging for the backplate-side electrical end of spacer 340 to be largely located in electrical-end plane 304.

Focusing system 333 can be replaced with another primary structure that does not significantly serve to focus electrons emitted by electron emitting structure 332, provided that the exposed material of the replacement primary structure is electrically conductive from its upper surface at least partway down its sidewalls so as to form a non-planar approximately equipotential surface extending from distance $d_s$ above emission-site plane 303 to distance $d_b$ above plane 303. As an example, the replacement primary structure can be sufficiently far from the electron emitting elements of sets 361–365 that it does not significantly affect the trajectories of electrons emitted by the electron emitting elements.

The backplate-side non-planar equipotential surface formed at the exposed conductive surface of focusing system 333, or its replacement, fully overlies emission-site plane 303 in flat panel display 300 or 500 or in the variations of display 300 or 500 described above. Alternatively, the non-planar equipotential surface provided by focusing system 333, or its replacement, can partially or fully underlie emission-site plane 303. For instance, spacer 340 and other such spacers can respectively extend into openings provided in electron emitting structure 332.

In such cases, distance db has a negative value. Distance $d_s$ may also be negative in value. Electrical-end plane 304 is still situated at intermediate distance $d_e$ relative to emission-site plane 303. Distance $d_e$ can thus be positive or negative depending on the values of distances $d_b$ and $d_s$. Once again, the potential field along spacer 340 near edge electrode 341 approximates the desired free-space potential field when the backplate-side electrical end of spacer 340 is largely located in electrical-end plane 304.

Figure 6:
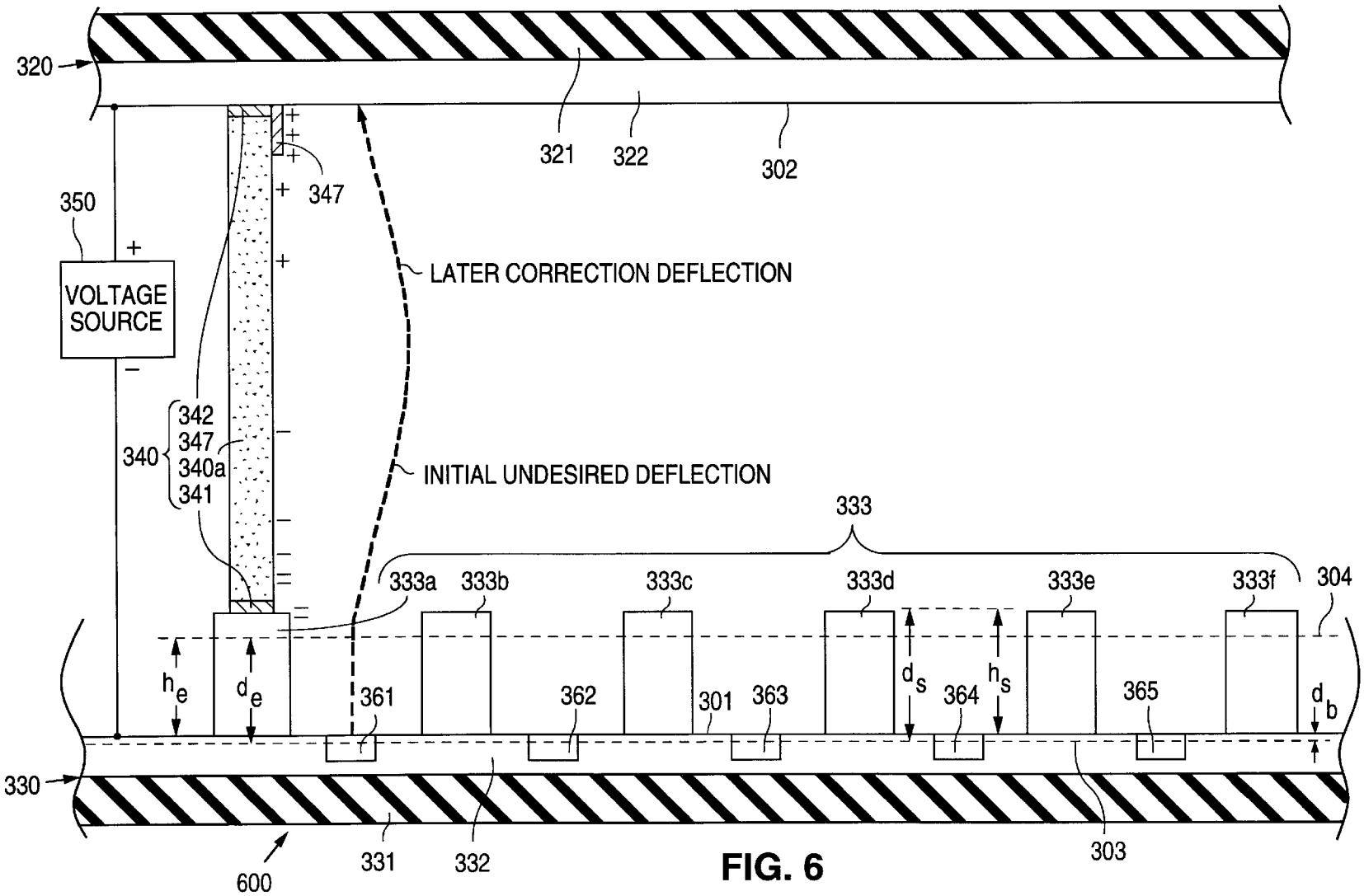

FIG. 6 schematically illustrates a portion of a flat panel CRT display 600 in accordance with another variation of the embodiment of FIG. 3. Because display 600 is similar to display 300, similar elements in FIGS. 3 and 6 are labeled with the same reference symbols. Display 600 of FIG. 6 does not have a groove at the upper surface of focusing structure 333*a*. While this advantageously reduces the cost of fabricating focusing system 333, the backplate-side electrical end of spacer wall 340 at edge electrode 341 is at height $h_s$ and thus is higher than the height $h_e$ of the electrical end of backplate structure 330. Consequently, an undesirable potential field exists near the interface of backplate-side edge electrode 341 and focusing structure 333*a*.

More particularly, the potential at backplate-side edge electrode 341 is approximately zero, and thus is less than the desired potential at height $h_s$. The potential field along spacer 340 near edge electrode 341 is illustrated by minus (−) signs in FIG. 6 since the potential field along spacer 340 near edge electrode 341 is negative with respect to the desired potential field along spacer 340 near edge electrode 341. Electrons emitted from electron emitting elements in set 361 are therefore initially deflected away from spacer 340 near edge electrode 341.

To correct for this initial electron deflection, an electrically non-insulating face electrode 347 is located on a face surface of main spacer portion 340*a* adjacent to light emitting structure 322. Face electrode 347 preferably consists of electrically conductive material, typically metal. The width, measured vertically, of face electrode 347 is 20–100 $\mu$m.

Face electrode 347 contacts edge electrode 342. As a result, face electrode 347 is held at voltage V. Because face electrode 347 extends partially down the face surface of spacer 340, face electrode 347 modifies the potential field along spacer 340 near light emitting structure 322. This potential field is illustrated by plus (+) signs near face electrode 347 in FIG. 6 since the potential field near face electrode 347 is positive with respect to the potential field which would exist at the same location in the absence of face electrode 347.

Face electrode 347 attracts electrons. Electrons deflected away from spacer 340 near edge electrode 341 are therefore deflected back toward spacer 340 near face electrode 347. The width of face electrode 347 is selected such that the initial electron deflection caused by the positioning of edge electrode 341 above height $h_e$ is approximately canceled by the later electron deflection produced by face electrode 347. In this way, the use of face electrode 347 compensates for edge electrode 341 at the backplate-side electrical end of spacer 340 being higher than the electrical end of backplate structure 330.

As indicated above in the material dealing with how the locations of the spacer's electrical ends are determined and as discussed further below in connection with FIGS. 17–23, the fact that face electrode 347 contacts faceplate-side edge electrode 342 means that the faceplate-side electrical end of spacer 340 is moved away from edge electrode 342 and up (down in the orientation of FIG. 6) spacer 340 toward backplate-side edge electrode 341. Consequently, the faceplate-side electrical end of spacer 340 is typically moved away, or further away, from being approximately coincident with the electrical end of faceplate structure 320. In essence, the non-coincidence of the electrical end of backplate structure 330 to the backplate-side electrical end of spacer 340 is compensated for by corresponding non-coincidence of the electrical end of faceplate structure 330 to the faceplate-side electrical end of spacer 340.

Focusing system 333 of flat panel display 600 can be fabricated according to various techniques. In display 600, focusing system 333 typically consists of an electrically non-conductive base focusing structure and an overlying electrically conductive focus coating that provides the backplate-side non-planar equipotential surface for focusing system 333. Inasmuch as no groove need be provided along the upper surface of focusing system 333 for receiving spacer 340, the non-conductive base focusing structure can be formed with a photo-patternable polymer using a frontside UV exposure technique. A suitable example of this technique is given in Knall et al, U.S. patent application Ser. No. 08/962,527, cited above. The focus coating can also be formed as described in Knall et al.

The embodiment of FIG. 6 can be modified in various ways. For example, face electrodes which contact edge electrode 342 can be formed on both face surfaces of spacer 340. In addition, edge electrode 341 can be located in a groove formed in the upper surface of focusing structure 333*a*. The groove has a depth which causes edge electrode 341 at the baseplate-side electrical end of spacer 340 to be positioned above height $h_e$.

Similar to what was said about the electrical-end matching procedure for flat panel display 300 or 500, the electrical-end compensation procedure for flat panel display 600 can be explained from a somewhat different perspective that facilitates generalizing the electrical-end compensation procedure. The electron emitting elements in sets 361–365 of display 600 again emit electrons from electron-emissive sites situated generally in emission-site plane 303 located below surface 301 of electron emitting structure 332. A backplate-side non-planar approximately equipotential surface runs along the exposed electrically conductive surface of focusing system 333 in display 600 from distance $d_s$ above emission-site plane 303 to distance $d_b$ above plane 303. The electrical end of backplate structure 330 in display 600 is located in backplate-side electrical-end plane 304 at distance $d_e$ above emission-site plane 303, where distance $d_e$ again lies between $d_b$ and $d_s$.

The voltage applied to the exposed conductive surface of focusing system 333 is typically decoupled from the voltages applied to the various parts of electron emitting structure 332 in flat panel display 600. The voltage decoupling comments presented above with respect to display 300 or 500 apply to display 600. Similarly, the exposed conductive surface of focusing system 333 in display 600 may extend only partway down the sidewalls of focusing system 333. The backplate-side electrical end of spacer 340 in display 600 occurs at distance $d_s$ above emission-site plane 303, and thus is located above electrical-end plane 304. Face electrode 347 of spacer 340 then controls the electron flow by compensating for the backplate-side electrical end of spacer 340 being located above electrical-end plane 304. The remarks made above about replacing focusing system 333 with a primary structure that does not significantly focus electrons apply to display 600.

Figure 7:
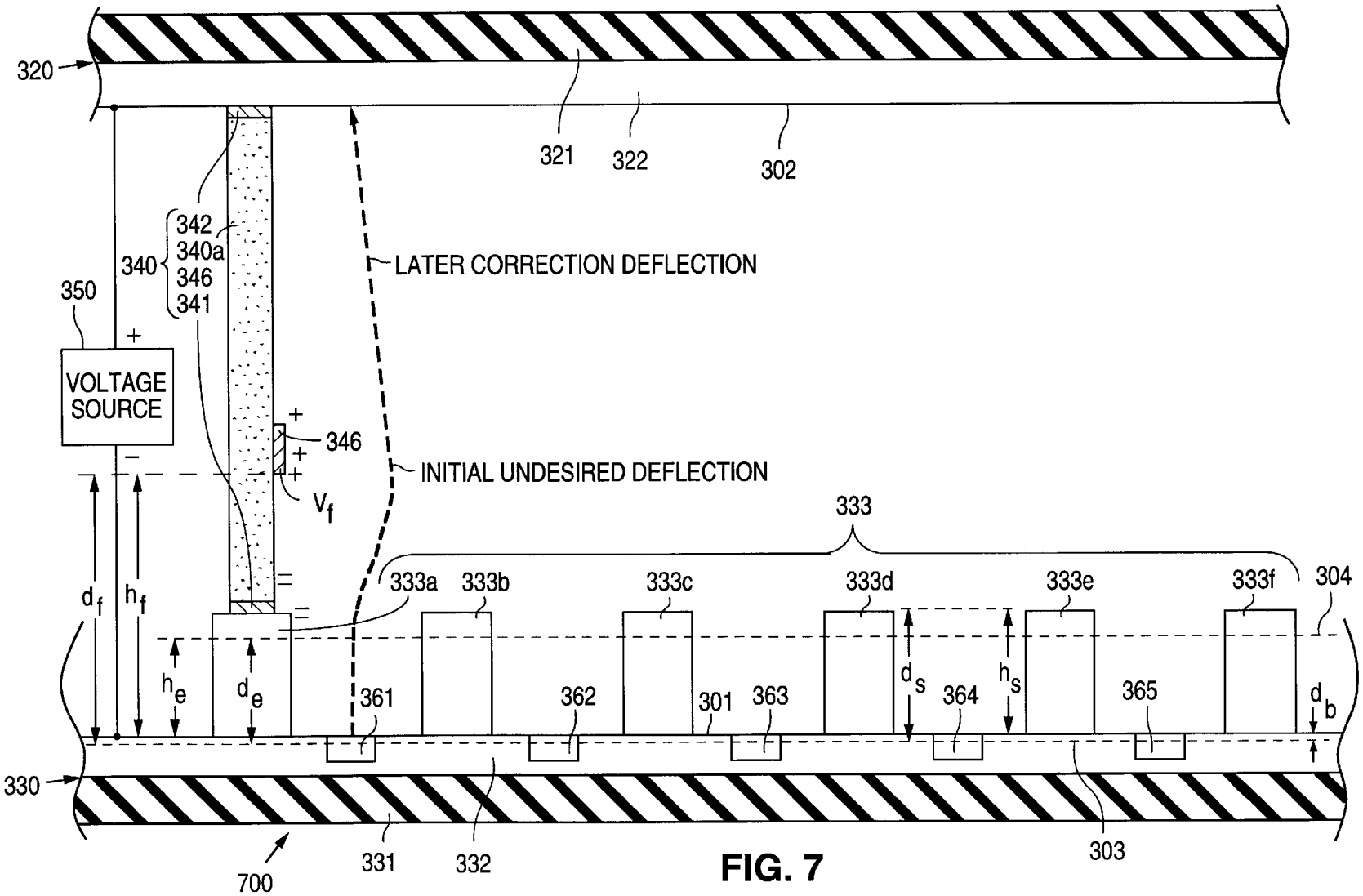

FIG. 7 schematically illustrates a portion of a flat panel display 700 in accordance with a variation of the embodiment of FIG. 6. Because display 700 is similar to display 600, similar elements in FIGS. 6 and 7 are labeled with the same reference symbols. In display 700, spacer 340 is modified to include an electrically conductive face electrode 346 located on a face surface of main spacer portion 340*a* spaced apart from edge electrodes 341 and 342. Face electrode 346 has a width, measured vertically, of 1–300 $\mu$m, typically 5–100 $\mu$m, and typically consists of metal.

Face electrode 346 is located at a height $h_f$ above surface 301. For the reasons presented above in connection with display 600 of FIG. 6, the potential field along spacer 340 near backplate-side edge electrode 341 in display 700 is more negative than the desired potential field along spacer 340 near edge electrode 341. A voltage $V_f$ is applied to face electrode 346 to largely correct for the relatively negative potential field adjacent to edge electrode 341. Voltage $V_f$ is higher, i.e., more positive, than the potential which would otherwise exist at height $h_f$ in the absence of face electrode 346.

Correction voltage $V_f$ can be provided to spacer 340 in various ways. FIGS. 8–11 illustrate four ways of generating voltage $V_f$.

Figure 8:
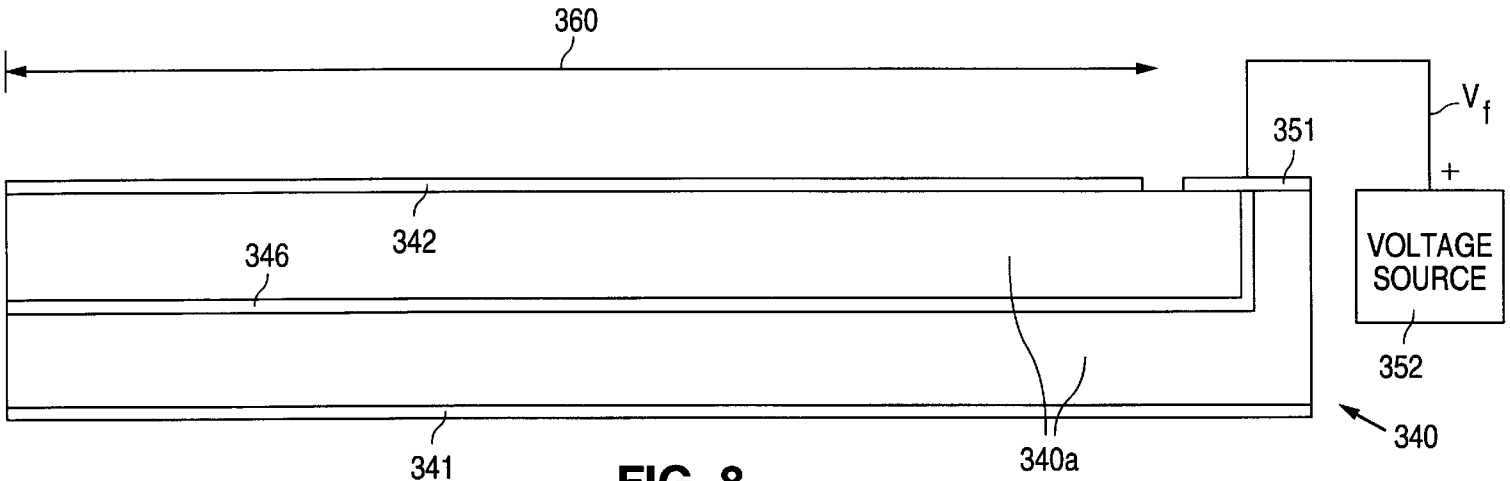
FIGS. 8–11 are side views of spacers employable in the flat panel display of FIG. 7.

FIG. 8 is a side view of an embodiment of spacer 340 suitable for flat panel display 700. Face electrode 346 extends in parallel with edge electrodes 341 and 342 within the display's active region 360. Outside of active region 360, face electrode 346 extends upward to contact an electrically conductive edge electrode 351 located on the same edge surface of main spacer portion 340*a* as edge electrode 342 but electrically isolated from edge electrode 342 by a gap. Edge electrode 351 is connected to a further voltage source 352 that furnishes correction voltage $V_f$. With this arrangement of spacer 340, voltage $V_f$ provided by voltage source 352 is transmitted through edge electrode 351 to face electrode 346. Voltage source 352 can be implemented as a tap on voltage source 350.

Figure 9:
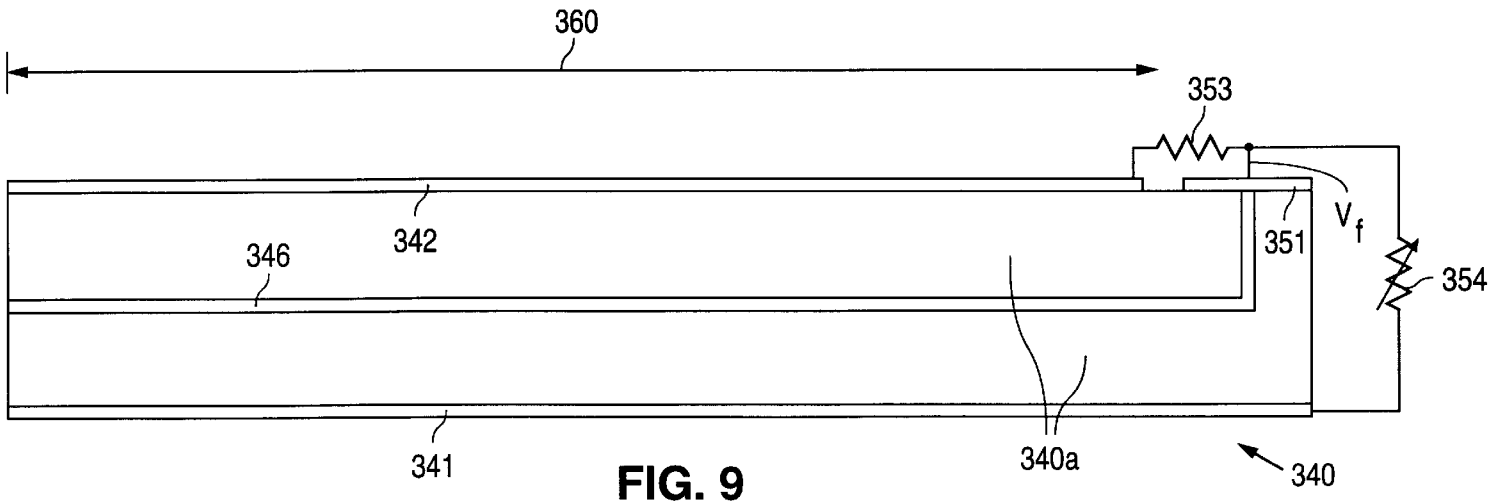

FIG. 9 is a side view of another embodiment of spacer 340 suitable for flat panel display 700. In this embodiment, a first resistor 353 is connected between edge electrode 342 and edge electrode 351. A second resistor 354 is connected between edge electrode 351 and edge electrode 341. Resistors 353 and 354 form a voltage divider. As previously described, edge electrode 342 is held at high voltage V, and edge electrode 341 is held at approximately 0 volt. Consequently, correction voltage $V_f$ at face electrode 346 is maintained at a value between zero and V depending on the values of resistors 353 and 354. Resistor 354 is typically a variable resistor which allows the voltage divider to be adjusted to provide voltage $V_f$ at an appropriate correction (or compensation) value. Again, voltage $V_f$ is controlled to largely correct for the relatively negative potential field along spacer 340 adjacent to edge electrode 341.

Figure 10:
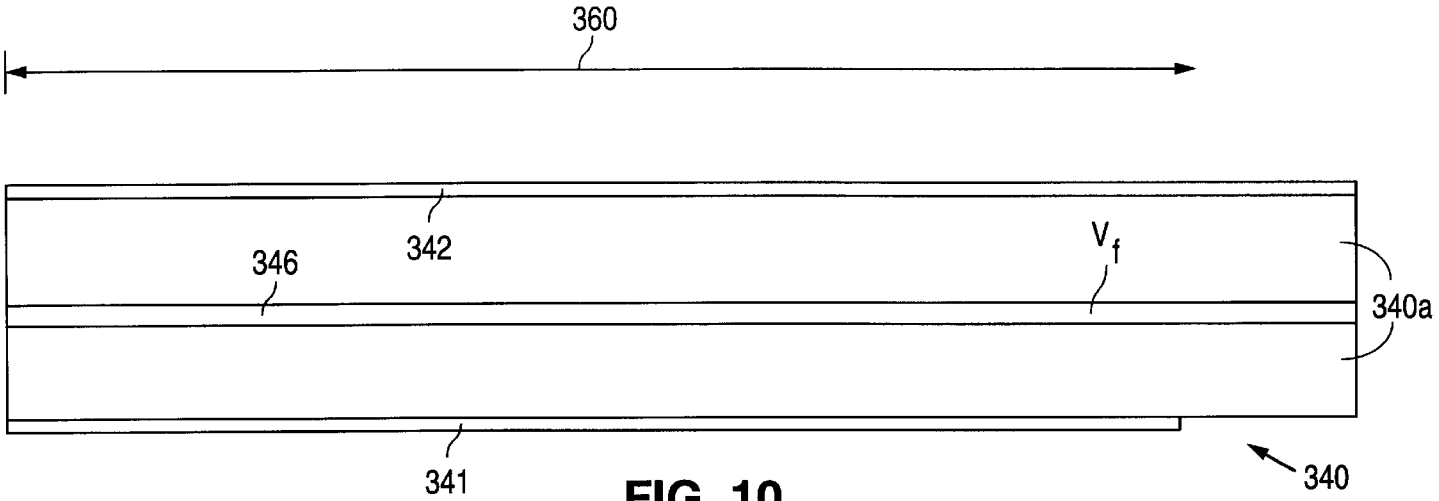

FIG. 10 is a side view of a third embodiment of spacer 340 suitable for flat panel display 700. In FIG. 10, face electrode 346 floats. That is, face electrode 346 is not connected to an electrical conductor that receives correction voltage $V_f$. Edge electrode 342 extends along the entire upper edge surface of main spacer 340*a*. However, edge electrode 341 extends only partway along the lower edge surface of main spacer portion 340*a*. Specifically, edge electrode 341 extends only to the edge of active region 360. The portion of edge electrode 342 extending beyond active region 360 causes the voltage of face electrode 346, i.e., correction voltage $V_f$, to increase slightly such that resistive dividing cause voltage $V_f$ to become slightly closer to high voltage V applied to edge electrode 342 than would occur if edge electrode 341 extended along the entire lower edge of main spacer portion 340*a*. Conversely, if it is desirable to lower correction voltage $V_f$, edge electrode 341 is modified to extend along the entire lower edge surface of main spacer portion 340*a*, while the portion of edge electrode 342 extending beyond active region 360 is eliminated.

Figure 11:
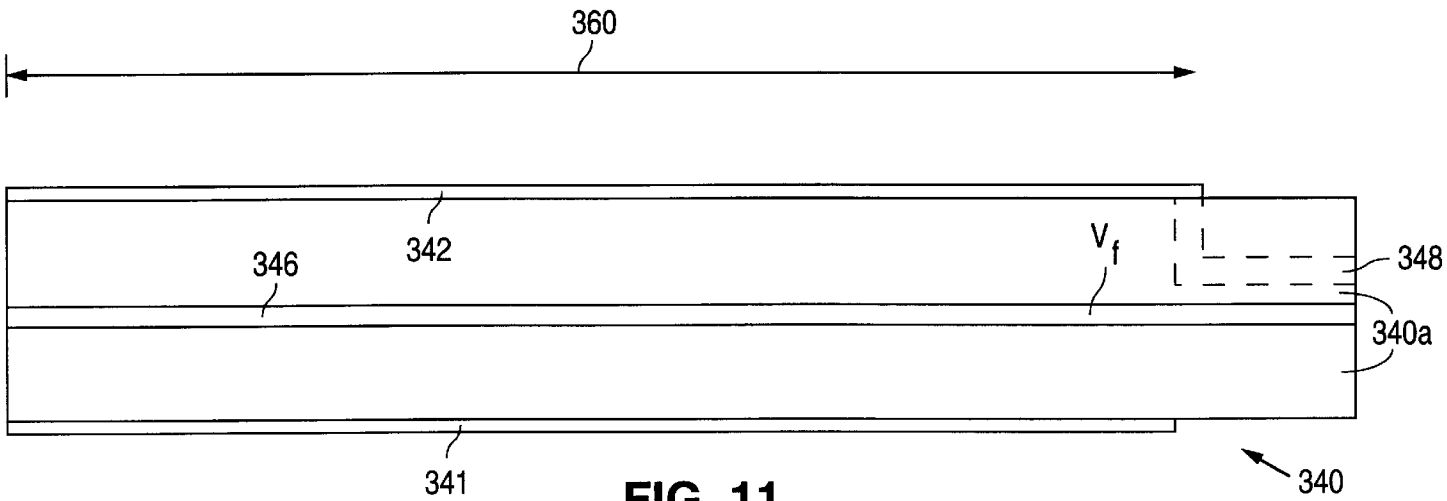

FIG. 11 is a side view of a fourth embodiment of spacer 340 suitable for flat panel display 700. Spacer 340 in FIG. 11 is a variation of spacer 340 in FIG. 10. In spacer 340 of FIG. 11, edge electrode 342 extends only to the edge of active region 360. An electrically conductive extension electrode 348 contacts edge electrode 342 at the edge of active region 360 and extends downward along the rear surface of main spacer portion 340*a*. The rear surface of main spacer portion 340*a* is the face surface opposite to that on which face electrode 346 is located. Due to resistive dividing, the presence of extension electrode 348 causes correction voltage $V_f$ on face electrode 346 to reach a higher value than voltage $V_f$ would reach if edge electrode 341 extended all the way across the upper edge of main spacer portion 340*a*. By locating extension electrode 348 on the rear surface of main spacer portion 340*a*, arcing between extension electrode 348 and face electrode 346 is inhibited.

Figure 12:
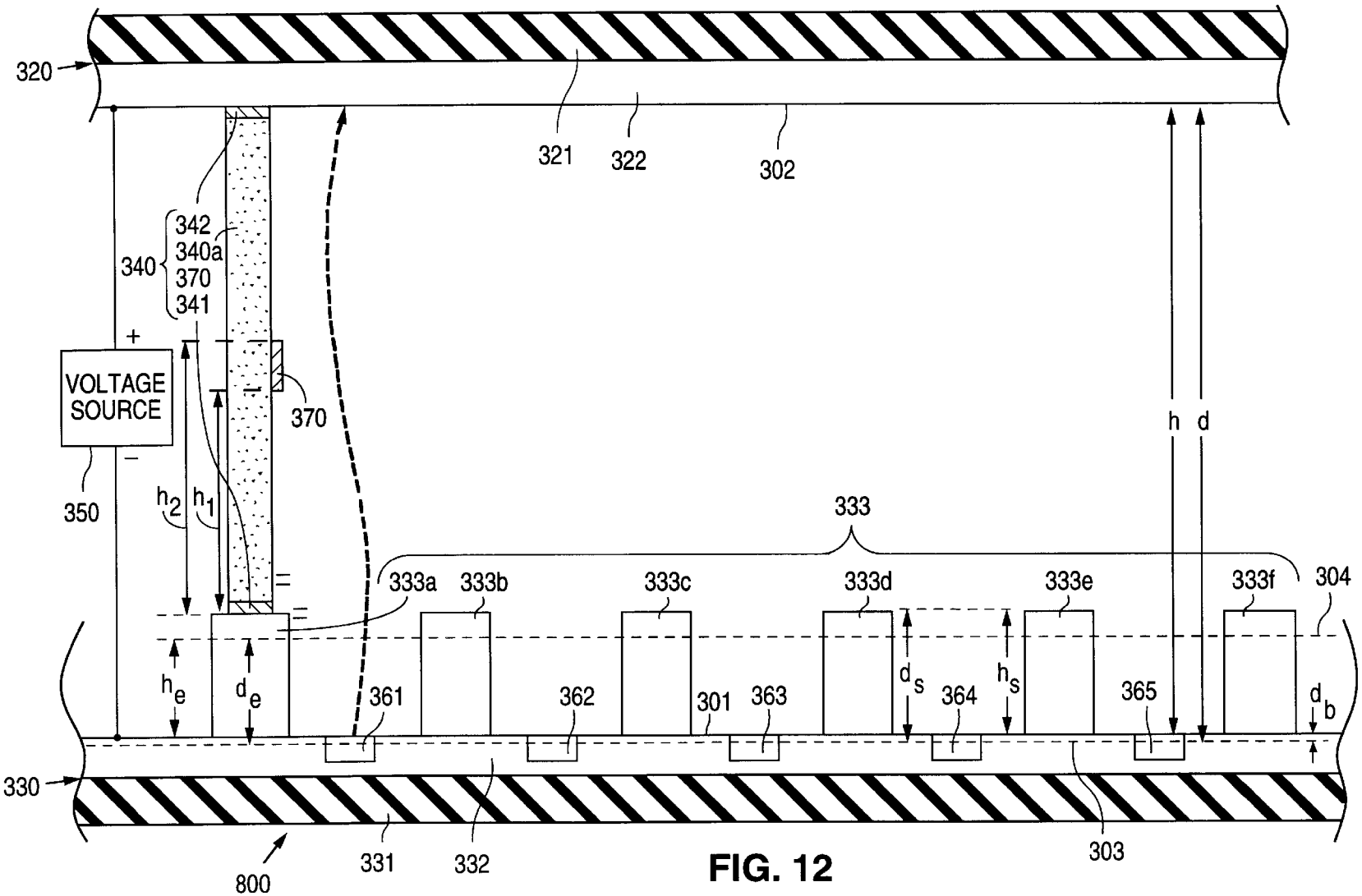
FIG. 12 is a schematic cross-sectional view of a portion of a flat panel CRT display which utilizes a spacer having a face electrode in accordance with the invention.

FIG. 12 schematically illustrates a portion of a flat panel CRT display 800 in accordance with a variation of the embodiment of FIG. 7. Because display 800 is similar to display 700, similar elements in FIGS. 7 and 12 are labeled with the same reference symbols. In display 800, spacer 340 includes an electrically non-insulating face electrode 370 similar to electrically conductive face electrode 346 of display 700. Face electrode 370 of display 800 is located on a face surface of main spacer portion 340*a* spaced apart from edge electrodes 341 and 342. The width, measured vertically, of face electrode 370 is 30–150 $\mu$m. Face electrode 370 preferably consists of electrically conductive material, typically metal.

Figure 13:
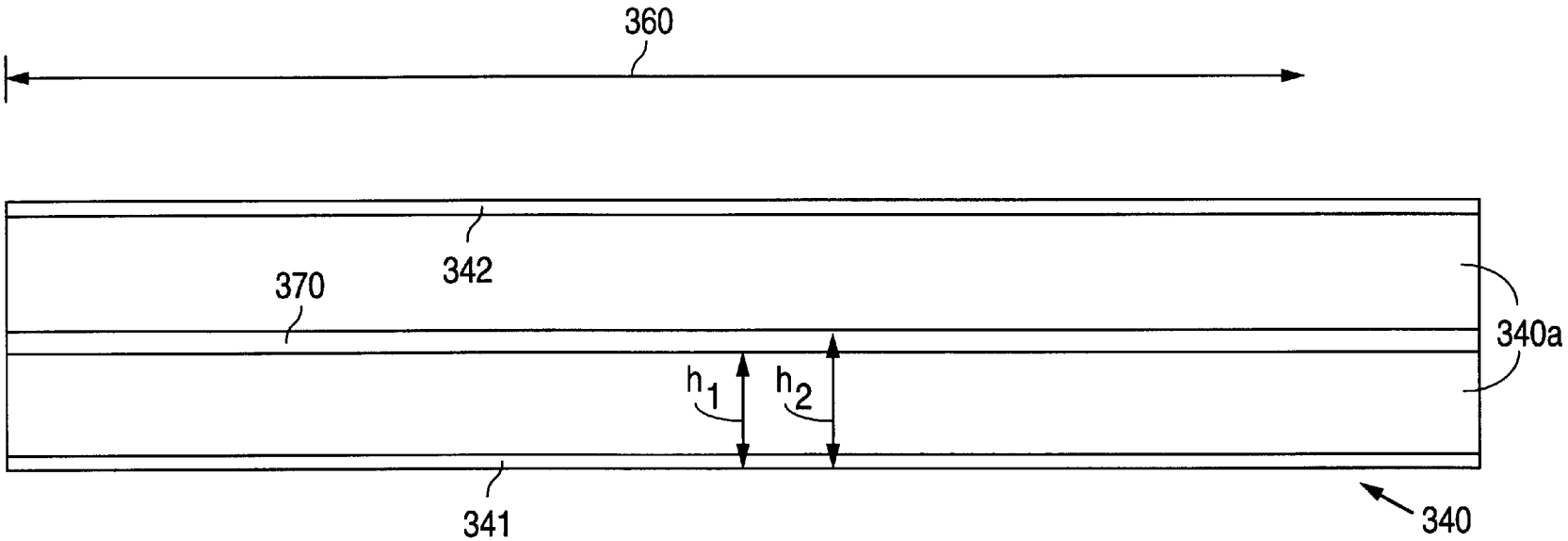
FIG. 13 is a side view of the spacer used in the flat panel display of FIG. 12.

FIG. 13 is a side view of spacer 340 in flat panel display 800. As indicated in FIG. 13, face electrode 370 extends across the face surface of main spacer portion 340*a* in parallel with edge electrodes 341 and 342. Face electrode 370 is not directly connected to an external voltage source. The lower edge of face electrode 370 is located at a first height $h_1$ above (the lower surface of) edge electrode 341. The upper edge of face electrode 370 is located at a second height $h_2$ above edge electrode 341.

Figure 14:
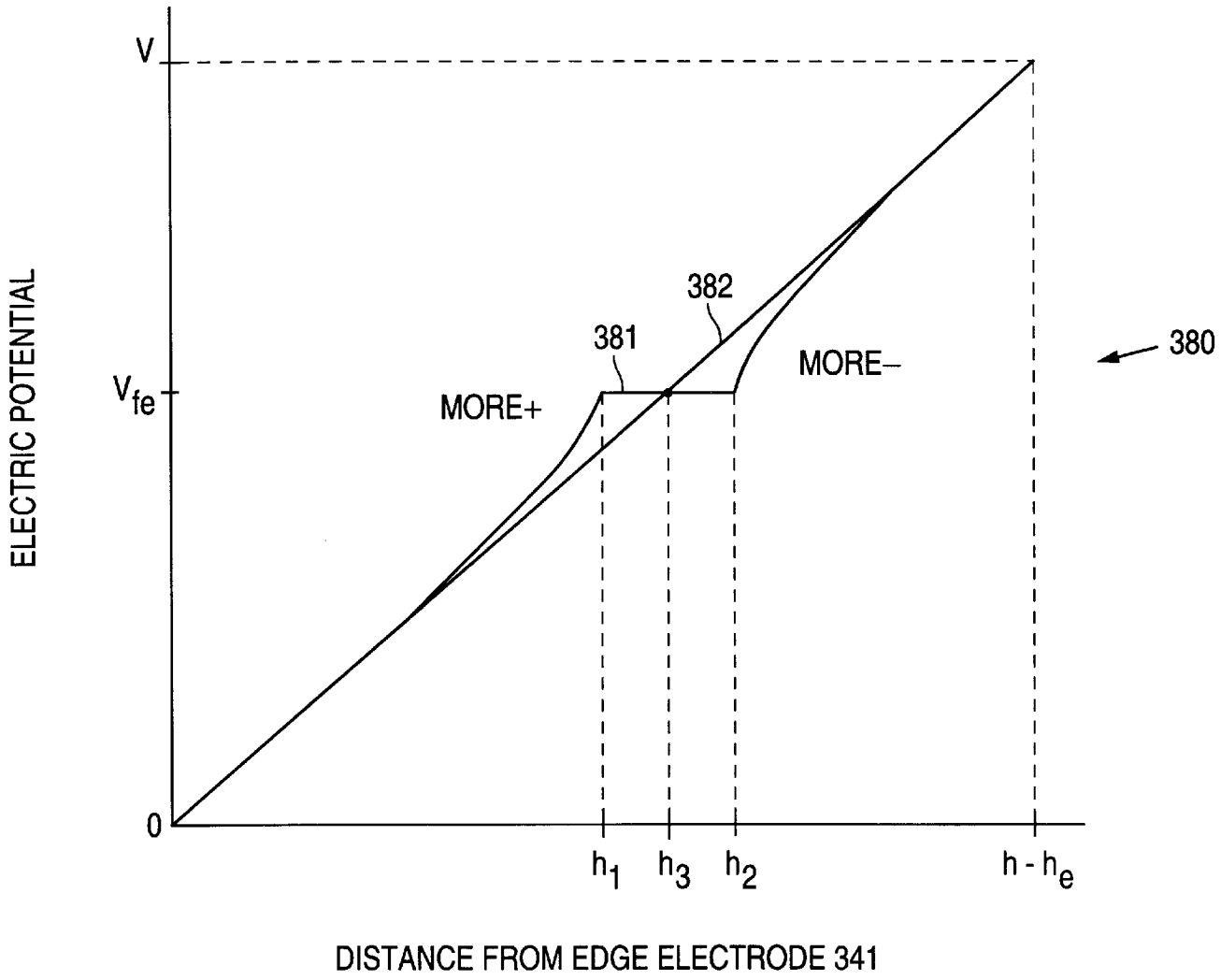
FIG. 14 is a graph of electric potential as a function of height along the spacer in FIGS. 12 and 13.

FIG. 14 is a graph 380 illustrating the approximate potential field along spacer 340 of flat panel display 800. Line 381 roughly illustrates the actual potential field along spacer 340. Line 382 roughly illustrates the potential field which would exist along spacer 340 in the absence of face electrode 370. Because face electrode 370 is electrically non-insulating, preferably electrically conductive, the voltage along the height (or width) of face electrode 370 from height $h_1$ to height $h_2$ is maintained at an approximately constant voltage $V_{fe}$.

Lines 381 and 382 in graph 380 both reach voltage $V_{fe}$ at a height $h_3$ above edge electrode 341. Below height $h_3$, potential field 381 is positive with respect to potential field 382. In the region below height $h_3$, spacer 340 which includes face electrode 370 thus exerts a greater attractive force on electrons than an otherwise identical spacer lacking face electrode 370. Above height $h_3$, potential field 381 is negative with respect to potential field 382. In the region above height $h_3$, spacer 340 therefore exerts a greater repulsive force on electrons than an otherwise identical spacer lacking face electrode 370.

Electrons emitted from electron emitting elements in set 361 accelerate when traveling toward light emitting structure 322. Consequently, these electrons move relatively slowly near the electron emitting elements of set 361, and relatively fast near light emitting structure 322. Slower moving electrons are attracted or repelled more in response to the potential field along spacer 340 than faster moving electrons. Because the electrons emitted from the electron emitting elements in set 361 move more slowly below height $h_3$ than above height $h_3$, the increased attractive force produced by face electrode 370 below height $h_3$ has a greater effect on these electrons than the increased repulsive force produced by face electrode 370 above height $h_3$. The net effect is that the electrons emitted from the electron emitting elements in set 361 are slightly attracted toward spacer 340. As a result, face electrode 370 can be used to correct for the relatively negative potential field adjacent to edge electrode 341 along spacer 340. The net attractive force produced by face electrode 370 can be adjusted by varying heights $h_1$ and $h_2$.

As with the electrical-end compensation procedure for flat panel display 600, the electrical-end compensation procedure for flat panel display 700 or 800 can be explained from a somewhat different perspective that facilitates generalizing the compensation procedure as applied to display 700 or 800. Referring to FIG. 7 or 12, electron emission from the electron emitting elements in sets 361–365 of display 700 or 800 originates at electron-emissive sites situated generally in emission-site plane 303 below surface 301 of electron emitting structure 332. Relative to emission-site plane 303, a backplate-side non-planar approximately equipotential surface runs along the exposed electrically conductive surface of focusing system 333 in display 700 or 800 from distance $d_s$ to distance $d_b$. The electrical end of backplate structure 330 in display 700 or 800 is located in primary electrical-end plane 304 at intermediate distance $d_e$.

The remarks made above about decoupling the voltage applied to the exposed conductive surface of focusing system 333 from the voltages applied to the various parts of electron emitting structure 332 apply to flat panel display 700 or 800. Likewise, the exposed conductive surface of focusing system 333 may extend only partway down its sidewalls in display 700 or 800. Relative to emission-site plane 303, the backplate-side electrical end of spacer 340 in display 700 or 800 is located at distance $d_s$ and thus again is situated above electrical-end plane 304. In display 700, face electrode 346 is located at a distance (or height) $d_f$ above emission-site plane 303, where distance $d_f$ equals $h_f+d_b$. With face electrode 346 or 370 being appropriately positioned and being provided with an appropriate control potential, face electrode 346 or 370 controls the electron flow by generating a local potential field that compensates for the backplate-side electrical end of spacer 340 being located above electrical-end plane 304. The remarks dealing with replacing focusing system 333 with a primary structure that does not significantly focus electrons apply to display 700 or 800.

Figure 15:
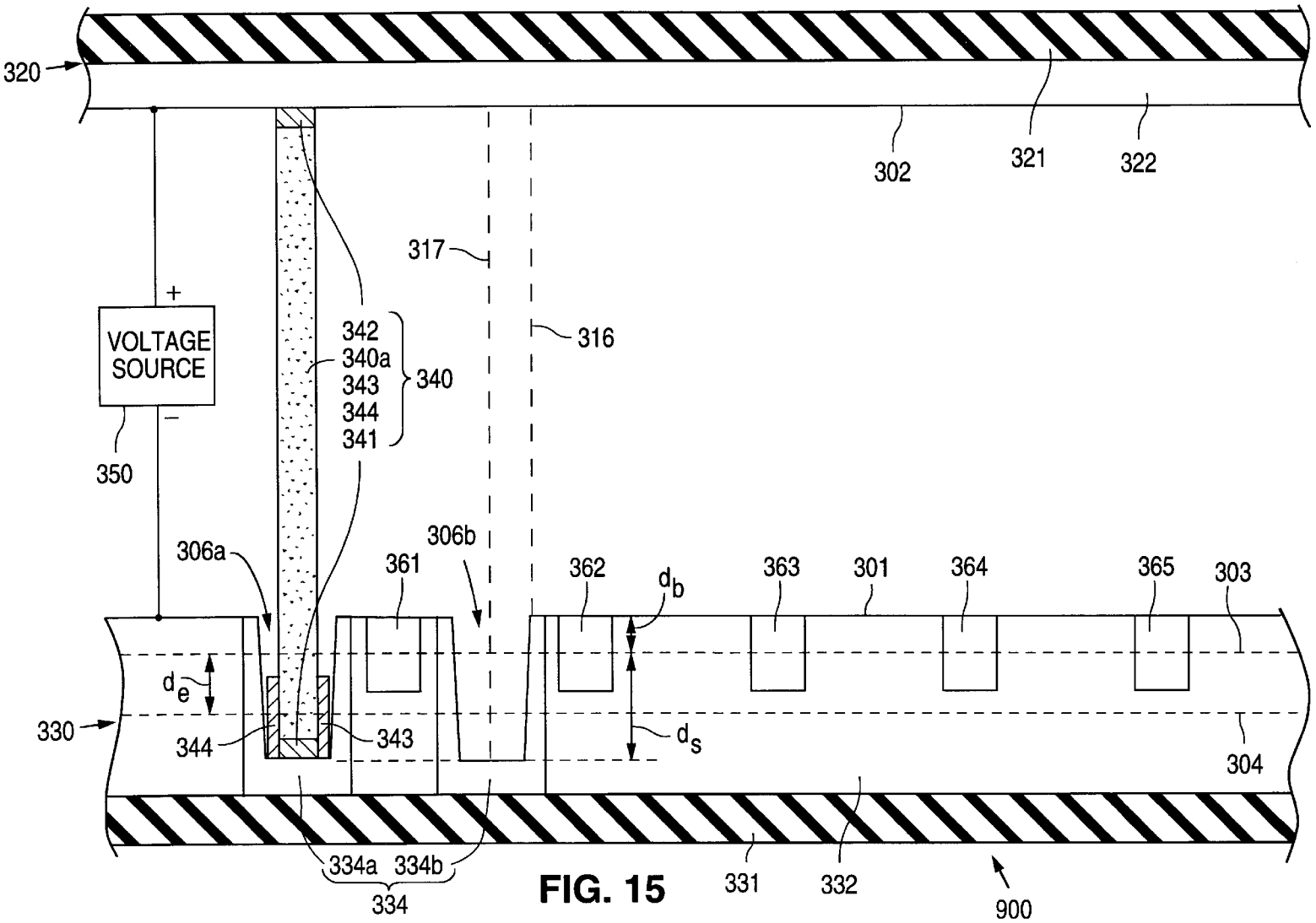
FIG. 15 is a schematic cross-sectional view of a portion of a flat panel CRT display in accordance with the invention.

As mentioned above, the non-planar equipotential surface provided by focusing system 333, or its replacement, can partially or fully underlie emission-site plane 303. FIG. 15 schematically illustrates a portion of a flat panel CRT display 900 in accordance with such a variation of the embodiment of FIG. 5. Because display 900 is similar to display 500, similar elements in FIGS. 5 and 15 are labeled with the same reference symbols.

A primary structure 334 consisting of one or more primary portions overlies backplate 331 in flat panel display 900. Two such primary portions 334*a* and 334*b* are shown in FIG. 15. Primary portions 334*a* and 334*b* can be spaced laterally apart from each other, or can be connected to each other at one or more locations outside the plane of FIG. 15. Primary structure 334 in display 900 replaces focusing system 333 in display 300.

In the example of FIG. 15, primary structure 334 laterally adjoins material of electron emitting structure 332. However, primary structure 334 can be spaced laterally apart from electron emitting structure 332. Also, instead of being situated directly on backplate 331 as shown in FIG. 15, primary structure 334 can be situated on part of electron emitting structure 332 above backplate 331. Furthermore, primary structure 334 can consist of material at least partially common with the material of electron emitting structure 332.

The upper surface of primary surface 334 is illustrated in FIG. 15 as being largely coplanar with the upper surface of electron emitting structure 332. Nonetheless, the upper surface of primary structure 334 can be significantly closer to, or significantly further away from, backplate 331 than the upper surface of electron emitting structure 332. Regardless of the vertical relationship between the upper surfaces of primary structure 334 and electron emitting structure 332, the upper surface of primary structure 334 is at distance $d_b$ away from emission-site plane 303. The upper surface of primary structure 334 can overlie emission-site plane 303 so that distance $d_b$ is positive in value as depicted in FIG. 15, or underlie plane 303 so that distance $d_b$ is negative in value.

Recessed spaces 306*a* and 306*b* are respectively provided in primary portions 334*a* and 334*b* along their upper surfaces starting at distance $d_b$ above emission-site plane 303. The bottom of each of primary portions 334*a* and 334*b* is at distance $d_s$ below plane 303. The value of distance $d_s$ is thus negative in FIG. 15.

A backplate-side non-planar approximately equipotential surface runs along the upper surfaces of portions 334*a* and 334*b* of primary structure 334, extends fully down the sidewalls of recessed spaces 306*a* and 306*b*, and typically extends across the bottoms of recessed spaces 306*a* and 306*b*. Consequently, the backplate-side non-planar equipotential surface extends from distance $d_b$ away from emission-site plane 303 to distance $d_s$ away from plane 303. Since distance $d_b$ is positive in the example of FIG. 15, the backplate-side non-planar equipotential surface partially overlies and partially underlies emission-site plane 303 in the illustrated example. When distance $d_b$ is negative so that the upper surface of primary structure 334 underlies plane 303, the backplate-side non-planar equipotential surface fully underlies plane 303. The backplate-side non-planar equipotential surface is formed by a layer of electrically conductive material.

The negative side of voltage source 350 is connected to primary structure 334 in order to provide a desired voltage to the backplate-side non-planar equipotential surface along the upper surface of structure 334. Consistent with how FIG. 5 is illustrated, FIG. 15 shows the negative side of voltage source 350 as being connected to electron emitting structure 332 since the voltages applied to electron emitting structure 332 and primary structure 334 are very low compared to the voltage applied by the positive side of voltage source 350 to the display's anode. However, similar to what was said above about decoupling the voltage applied to focusing system 333 from the voltages applied to the various parts of electron emitting structure 332, the voltage applied to primary structure 334 in display 900 is typically decoupled from the voltages applied to the parts of electron emitting structure 332. Although the voltage provided from the negative side of voltage source 350 is roughly the average voltage present in the various parts of electron emitting structure 332, the negative side of voltage source 350 is not actually connected to electron emitting structure 332.

Backplate structure 330 in FIG. 15 has an electrical end situated at distance $d_e$ below emission-site plane 303. With distance $d_e$ being of negative value here, the electrical end of backplate structure 330 is again located in backplate-side electrical-end plane 304. Similar to what was said above about the electrical end of backplate structure 330 in display 300, the capacitance between faceplate structure 320 and an imaginary electrically conductive plate situated at emission-site plane 304 in a spacer-free region along backplate structure 330 (e.g., along at least primary portion 334*b*) is typically approximately equal to the capacitance between faceplate structure 320 and backplate structure 330, including primary structure 334, in the indicated spacer-free region. Assuming that no spacer contacts primary portion 334*b*, the indicated spacer-free region of display 900 for purpose of this capacitance equality can, for example, be the region extending along primary structure 334 (a) from a vertical plane situated equidistant between primary portions 334*a* and 334*b* to (b) a vertical plane situated the same distance to the right of primary portion 334*b*.

Spacer 340 of flat panel display 900 is situated between faceplate structure 322 and primary portion 334*a*. As in display 500, spacer 340 consists of main spacer portion 340*a*, edge electrodes 341 and 342, and face electrodes 343 and 344 that contact backplate-side edge electrode 341. The backplate-side end of spacer 340 extends into recessed space 306*a*. The characteristics of face electrodes 343 and 344 are chosen in such a manner that the backplate-side electrical end of spacer 340 is approximately at distance $d_e$ below emission-site plane 303. Hence, the backplate-side electrical end of spacer 340 lies largely in electrical-end plane 304 and is largely coincident with the electrical end of backplate structure 330. Due to this coincidence, the potential field along spacer 340 near edge electrode 341 closely approximates the potential field that would exist at the same location in free space, i.e., in the absence of spacer 340, between faceplate structure 320 and backplate structure 330, including primary structure 334. At least in the vicinity of edge electrode 341, spacer 340 is therefore largely electrically transparent to the movement of electrons from electron emitting structure 332 to light emitting structure 322.

Figure 16:
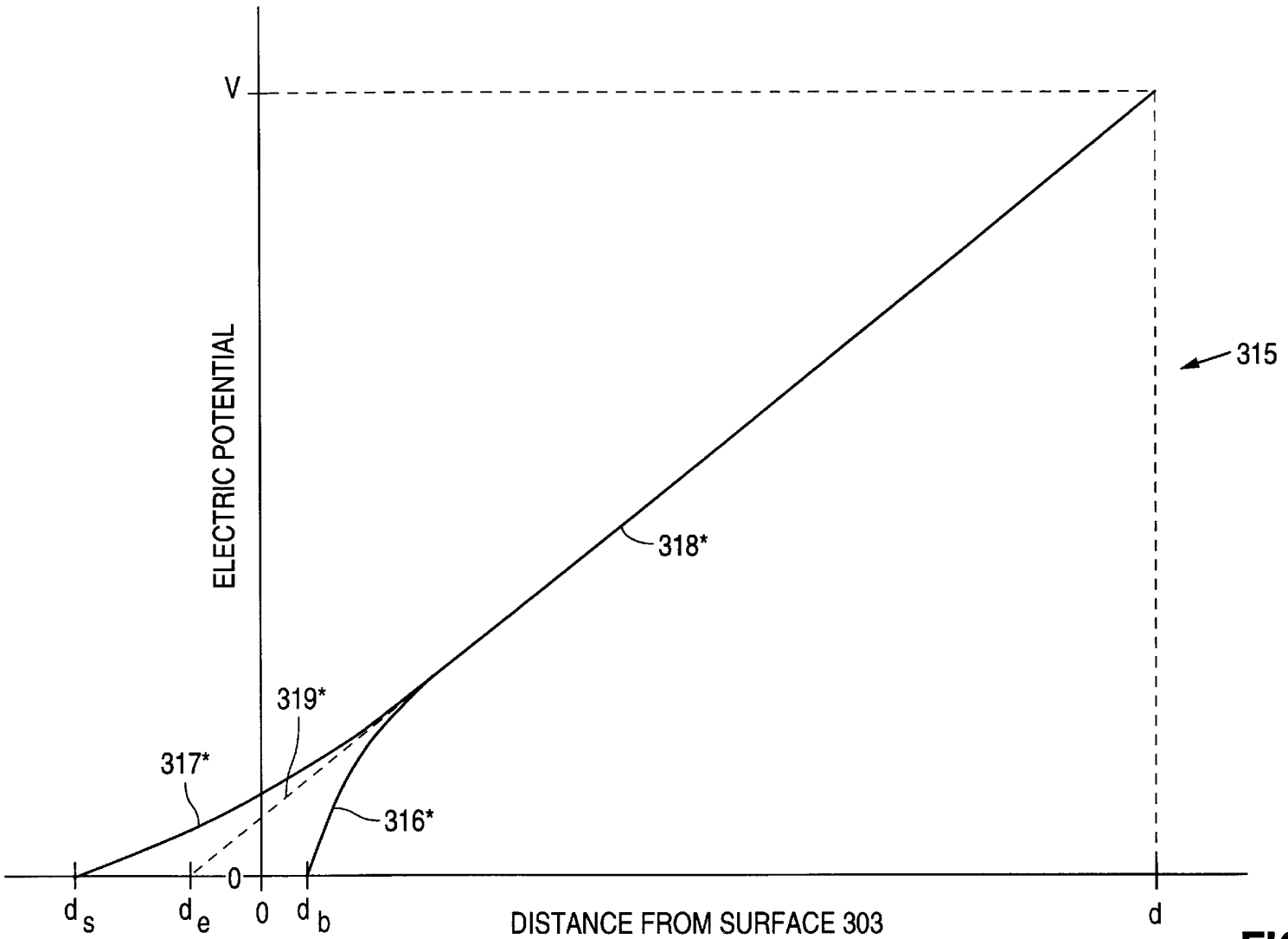
FIG. 16 is a graph of electric potential as a function of height at various locations in the flat panel display of FIG. 15.

FIG. 16 is a graph 315 employed to determine distance $d_e$ for flat panel display 900. Graph 315 is an analogous to graph 311 utilized to determine height $h_e$, and thus distance $d_e$, for display 300. Similar to graph 311, the vertical coordinate for graph 315 presents the electric potential inside display 900 for the representative situation in which the voltage provided for the backplate-side non-planar equipotential surface of primary structure 334 is zero. The potential within display 900 thus varies from zero at primary structure 334 to V at the anode adjoining light emitting structure 322. The horizontal coordinate of graph 315 presents the distance measured from emission-site plane 303. This distance varies from zero at plane 303 to d at surface 302 of light emitting structure 322.

Curves 316* and 317* in graph 315 respectively roughly represent the potentials along lines 316 and 317 of FIG. 15. Lines 316 and 317 both originate at the backplate-side non-planar equipotential surface of primary structure 334 where the potential is zero, and terminate at surface 302 of light emitting structure 322 adjacent to the display's anode. Lines 316 and 317 differ in that line 316 originates at distance $d_b$ at the top of primary structure 334 whereas line 317 originates at distance $d_s$ at the bottom of recessed space 306*b*. The potential represented by curve 316* thus goes from zero at distance $d_b$ to V at distance d. In contrast, the potential represented by curve 317* goes from zero at distance $d_s$ to V at distance d.

With curves 316* and 317* both reaching potential V at distance d, they converge to a common line 318* of constant slope. Dashed line 319* in graph 315 represents the extrapolation of straight line 318* to the horizontal axis of graph 315. The combination of lines 318* and 319* illustrates how the potential would vary in free space between two capacitive plates, one located at electrical-end plane 304, and the other located at surface 302 of light emitting structure 322. Consequently, the intersection of line 319* with the horizontal axis of graph 315 defines distance $d_e$.

Figure 17:
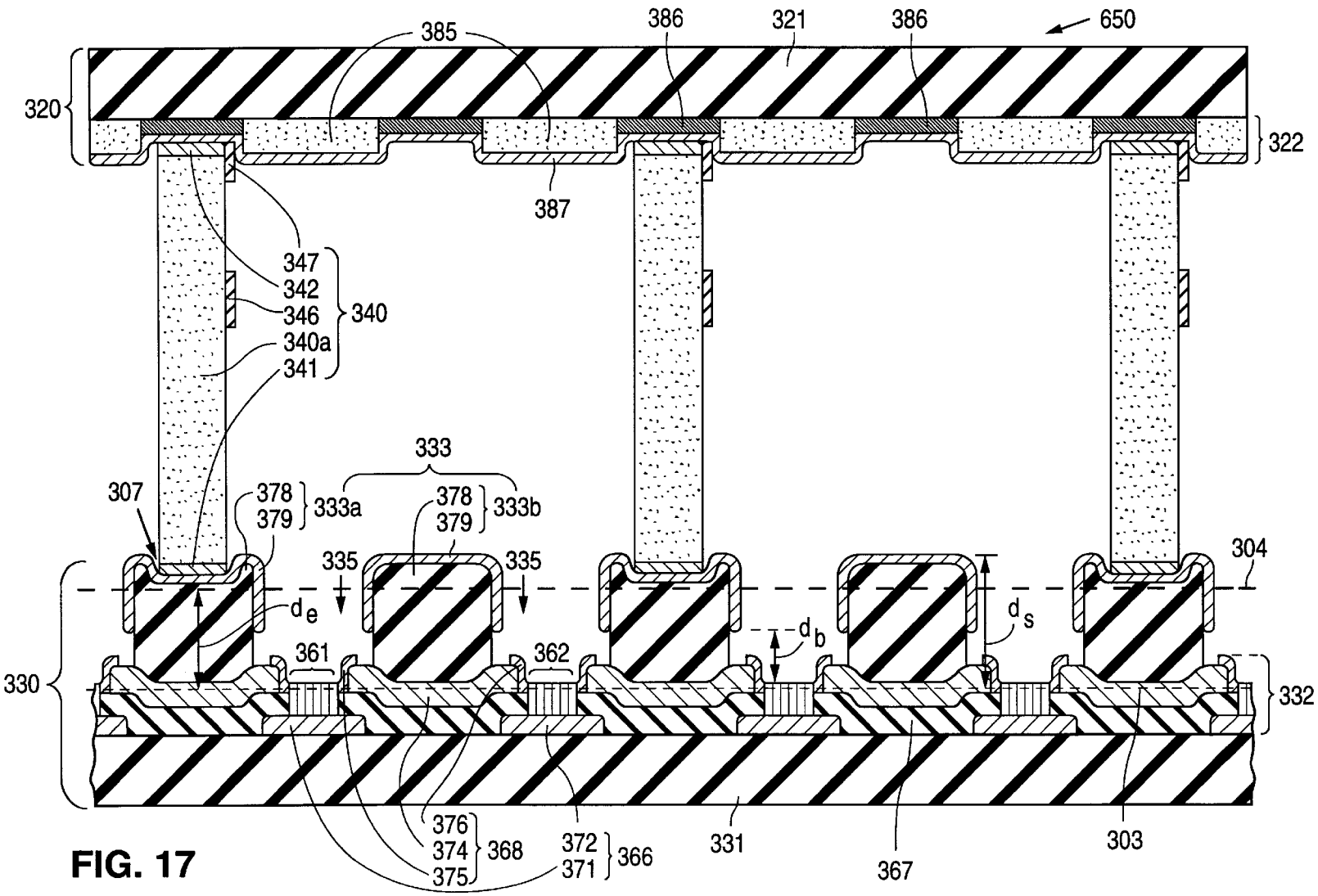
FIG. 17 is a cross-sectional view of a portion of a flat panel CRT display which utilizes spacers having face electrodes arranged in accordance with the invention.

FIG. 17 illustrates a portion of an implementation 650 of a composite of flat-panel displays 600 and 700 of FIGS. 6 and 7. Three largely identical internal spacers are shown in FIG. 17. One of the spacers is labeled 340 in flat panel CRT display 650 and contains both face electrode 347 of display 600 and face electrode 346 of display 700. Subject to this, similar elements in FIGS. 6, 7, and 17 are labeled with the same reference symbols.

Electron emitting structure 332 in flat panel display 650 consists of a lower electrically non-insulating emitter region 366, a dielectric layer 367, a group of generally parallel control electrodes 368, and a two-dimensional array of sets of electron emitting elements of which sets 361 and 362 are labeled in FIG. 17. Lower non-insulating region 366, which lies on the interior surface of backplate 331, contains a group of generally parallel emitter electrodes extending in the row direction, i.e., the direction along the rows of picture elements (pixels) in display 650. The row direction is perpendicular to the plane of FIG. 17. Two emitter electrodes 371 and 372 are labeled in FIG. 17. Emitter electrodes 371 and 372 respectively underlie sets 361 and 362 of the electron emitting elements. Non-insulating region 366 normally also includes an electrically resistive layer (not shown) overlying the emitter electrodes. Dielectric layer 367 overlies non-insulating region 366.

Control electrodes 368 lie on top of dielectric layer 367. Each control electrode 368 consists of (a) a main control portion 374 extending in the column direction, i.e., the direction along the columns of pixels in display 650, and (b) a set of thinner gate portions adjoining main control portion 374. Two gate portions 375 and 376 are labeled in FIG. 17. A set of control apertures respectively corresponding to the gate portions of each control electrode 374 extend through that control electrode 374. Each gate portion, such as gate portion 375 or 376, spans one of the control apertures. FIG. 17 illustrates one control electrode 368, the column direction extending horizontally, perpendicular to the plane of the figure.

Each electron emitting element is situated in a corresponding opening through dielectric layer 367 down to non-insulating region 366 at the location for one of the emitter electrodes, such as emitter electrode 371 or 372, and is exposed through a corresponding opening in the overlying one of the gate portions, such as gate portion 375 or 376. The openings through dielectric layer 367 and the gate portions are not shown explicitly in FIG. 17. The two-dimensional array of sets of electron emitting elements, such as sets 361 and 362, are defined by the sidewalls of the control apertures through main control portions 374. The electron emitting elements are illustrated qualitatively in FIG. 17. In a typical implementation, the electron emitting elements are generally shaped as upright cones or sharpened filaments.

Focusing system 333 is situated on control electrodes 368, specifically main control portions 374, and on parts (not shown in FIG. 17) of dielectric layer 367. As viewed perpendicular to the interior surface of backplate 331, focusing system 333 is configured generally in a waffle-like pattern. Focusing structures 333*a* and 333*b* and the other focusing structures that form focusing system 333 are connected together outside the plane of FIG. 17.

Focusing system 333 consists of a base focusing structure 378 and an electrically conductive focus coating 379 that lies on top of base focusing structure 378 and extends partway down its sidewalls into apertures 335 through focusing system 333. One set of the electron emitting elements, such as set 361 or 362, is exposed through each different focus aperture 335. Base focusing structure 378 is formed with electrically insulating and/or electrically resistive material.

Focus coating 379 forms the backplate-side non-planar equipotential surface of focusing system 333 in flat-panel display 650. Since focus coating 379 extends only partway down the sidewalls of base focusing structure 378, the backplate-side non-planar equipotential surface in display 650 does not extend down to electron emitting structure 332. Distance $d_b$ from emission-site plane 303 to the lower edge of the backplate-side non-planar equipotential surface thus extends upward beyond the upper surface of electron emitting structure 332 in FIG. 17. The negative side of voltage source 350 (not shown in FIG. 17) is connected to focus coating 379 at one or more locations outside the cross section shown in FIG. 17 so as to establish a desired focus potential, typically 0 volt, on focus coating 379.

In FIG. 17, backplate-side edge electrode 341 of spacer 340 is shown as extending into an optional groove (recessed space) 307 provided along the upper surface of focusing structure 333*a*. Specifically, groove 307 is formed in the portion of focus coating 379 at the top of focusing structure 333*a*. In turn, the portion of focus coating 379 that defines groove 307 overlies a corresponding groove in base focusing structure 378.

Groove 307 can, when present, be formed by creating a groove in base focusing structure 378 along its upper surface at the desired location for groove 307 and then forming focus coating 379 over base focusing structure 378. Alternatively, groove 307 can be partially or wholly formed as a result of the force exerted by spacer 340 on focusing structure 333*a* when spacer 340 is inserted between plate structures 320 and 330 during display assembly. For the case in which groove 307 is substantially absent or arises wholly due to the force exerted by spacer 340 on focusing structure 333*a* during display assembly, further information on the fabrication of components is presented in Spindt et al, U.S. patent application Ser. No. 08/866,150, now allowed and Knall et al, U.S. patent application Ser. No. 08/962,527, cited above. In any event, groove 307 is not deep enough for the backplate-side electrical end of spacer 340 at edge electrode 341 to be largely coincident with the electrical end of backplate structure 330. As FIG. 17 shows, edge electrode 341 lies above electrical-end plane 304.

The presence of backplate-side edge electrode 341 in groove 307 does cause the potential field along spacer 340 near edge electrode 341 to be modified towards the potential field that would exist at the same location in free space between faceplate structure 320 and backplate structure 330, including focusing system 333. However, the potential field along spacer 340 near edge electrode 341 in display 650 does not substantially reach the potential field that would exist in the same location in free space between plate structures 320 and 330. Accordingly, spacer 340 in display 650 does cause some undesired initial electron deflection. Face electrodes 346 and 347 modify the potential field along spacer 340 near where they are located so as to produce oppositely directly electron deflection which, in the manner described above, largely corrects for the initial undesired electron deflection.

Alternatively, one of face electrodes 346 and 347 can be deleted in display 650. The resulting flat panel CRT display is then an implementation of display 600 if face electrode 346 is deleted, or an implementation of display 700 if face electrode 347 is deleted. As a further alternative, face electrodes 346 and 347 can both be deleted in display 650 provided that the depth of groove 307 is increased sufficiently to enable backplate-side edge electrode 341 to lie in electrical-end plane 304. In this case, the resulting flat panel CRT display is an implementation of display 300. Groove 307 effectively becomes groove 305 in display 300.

As in flat panel display 600 and 700, focusing system 333 in flat panel display 650 can be replaced with another primary structure that does not significantly focus electrons emitted by electron emitting structure 332. Likewise, the backplate-side non-planar equipotential surface provided by focus coating 379 of focusing system 333, or its replacement, can partially or fully underlie emission-site plane 303 in display 650. The variations of FIG. 15 can thus be applied to display 650.

Returning to flat panel display 650 as shown in FIG. 17, light emitting structure 322 consists of a two-dimensional array of phosphor light emissive elements 385 and a black matrix 386. Light emissive elements 387 are situated on the interior surface of backplate 321 respectively across from the sets, such as sets 361 and 362, of the electron emitting elements. Black matrix 386 overlies the interior surface of backplate 321 in the waffle-like space between light emissive elements 385. The display's anode consists of an electrically conductive light reflective layer 387 situated on light emissive elements 385 and black matrix 386. Further information on typical implementations of components 385–387 is presented in Haven et al, U.S. patent application Ser. No. 08/846,522, now allowed, hereby incorporated by reference.

Electrical-end matching similar to that described above for the backplate side of a flat panel CRT display containing one or more internal spacers situated between the faceplate and backplate structures of the display can be performed on the faceplate side of the display. FIGS. 18*a* and 18*b* perspectively illustrate an embodiment of faceplate structure 320 configured to achieve faceplate-side electrical-end matching. FIG. 18*a* depicts how faceplate structure 320 appears before anode 387 is formed and thus before spacer 340 is brought into contact with anode 387. FIG. 18*b* shows the situation after anode 387 is formed and spacer 340 is contacted with anode 387. FIG. 19 presents a cross section of faceplate structure 320 and spacer 340 of FIG. 18*b* taken along the vertical plane indicated by arrow 19 in FIG. 18*b*. In FIGS. 18*a*, 18*b*, and 19, faceplate structure 320 is upside down from that shown in the previous figures.

Faceplate structure 320 in FIGS. 18*a*, 18*b*, and 19 provides a color image on the exterior viewing surface of faceplate 321. The letters "R", "G", and "B" attached to electron emissive elements 385 in FIG. 18*a*, 18*b*, and 19 indicate phosphors that respectively emit red, green, and blue light. Each color pixel consists of three light emissive elements 385 in adjoining columns.

Spacer 340 in FIGS. 18*b* and 19 contains face electrodes 346 and 347 in addition to edge electrode 342 and edge electrode 341 (not shown here). Accordingly, faceplate structure 320 of FIGS. 18*b* and 19 is particularly suitable for use in flat panel display 650 of FIG. 17. However, one or both of face electrodes 346 and 347 can be deleted so that faceplate structure 320 of FIGS. 18*b* and 19 is suitable for use in any of displays 300, 500, 600, 700, and 800.

Referring to FIG. 18*a*, black matrix 386 consists of (a) a group of row strips 391 extending in the row direction and (b) an adjoining taller patterned portion 392 formed with bars extending in the row direction and strips extending in the column direction. One row strip 391 is depicted in FIG. 18*a*. A row channel 393 is present above each row strip 391. The row bars of patterned portion 392 form the sidewalls of row channels 393.

Turning to FIGS. 18*b* and 19, a main structure consisting of anode layer 387 is formed on light emissive elements 385 and black matrix 386. Row channels 393 thereby become channels (recessed spaces) 394 in anode layer 387. The faceplate-side end of spacer 340 is inserted into one of channels 394. Accordingly, edge electrode 342 of spacer 340 contacts focus coating 387 in channel 394. The positive side of voltage source 350 (not shown here) is connected to anode layer 387 so that anode 387 is maintained at a high voltage during display operation.

The interior surface of faceplate 321 lies in a faceplate plane 308 as shown in FIG. 19. Anode layer 387, specifically its exposed surface, forms a faceplate-side non-planar approximately equipotential surface. The highest parts of anode 387 are situated on the row bars of black matrix portion 392 at a distance $c_s$ above faceplate plane 308. The lowest parts of anode 387 are situated on light emissive elements 385 at a distance $c_b$ above plane 308. The faceplate-side non-planar equipotential surface formed with anode 387 is thus situated above plane 308 at a distance varying from $c_b$ to $c_s$.

Faceplate structure 320, including anode layer 387, has an electrical end situated at a distance $c_e$ above faceplate plane 308. Distance $c_e$ lies between $c_b$ and $c_s$. The electrical end of faceplate structure 320 is located in a faceplate-side electrical-end plane 309 extending parallel to faceplate plane 308. As with backplate structure 330, the physical location of the electrical end of faceplate structure 320 is determined by using a potential-versus-height (or distance) graph of the type shown in FIG. 4. The electrical end of faceplate structure 320 occurs at the place where the extrapolation of the straight line representing the potential relatively far away from faceplate structure 320 intersects the horizontal axis.

In this regard, the capacitance between backplate structure 330 and an imaginary electrically conductive plate situated at faceplate-side electrical-end plane 309 in a spacer-free region extending along anode 387 opposite at least one of focusing structures 338*b*–338*f*, or their equivalents in primary structure 334, is typically approximately equal to the capacitance between backplate structure 330 and faceplate structure 320, including anode 387, in the indicated spacer-free region. Assuming that no spacers contact focusing structures 338*a*–338*e* or their equivalents, the spacer-free region of the flat-panel display for purpose of this capacitance equality can, for example, be the region extending along anode 387 from (a) a vertical plane situated equidistant between focusing structures 333*a* and 333*b* or their equivalents to (b) a vertical plane situated equidistant between focusing structures 333*e* and 333*f* or their equivalents.

For the same reason that the presence of face electrodes 343 and 344 causes the backplate-side electrical end of spacer 340 in flat panel display 500 to be located up main spacer portion 340 spaced somewhat apart from backplate-side edge electrode 341, the presence of face electrode 347 in a flat-panel display employing components 320 and 340 of FIGS. 18*b* and 19 causes the faceplate-side electrical end of spacer 340 to be located up spacer 340 spaced somewhat apart from faceplate-side edge electrode 342.

The depth of channel 394 in anode layer 387 is chosen such that the faceplate-side electrical end of spacer 340 in FIGS. 18*b* and 19 lies in backplate-side electrical-end plane 309. As a result, the potential field along spacer 340 near edge electrode 342 approximates the potential field that would exist at the same location in free space between backplate structure 330 and faceplate structure 320, including anode 387. Except for electrons that actually strike spacer 340, the portion of spacer 340 near edge electrode 342 is largely electrically transparent to electrons moving from electron emitting structure 332 to light emitting structure 322. As with the backplate-side electrical-end matching, the degree to which spacer 340 is electrically transparent to the electron movement generally increases as the faceplate-side electrical-end of spacer 340 becomes closer to coincident with the electrical end of faceplate structure 320.

Figure 21:
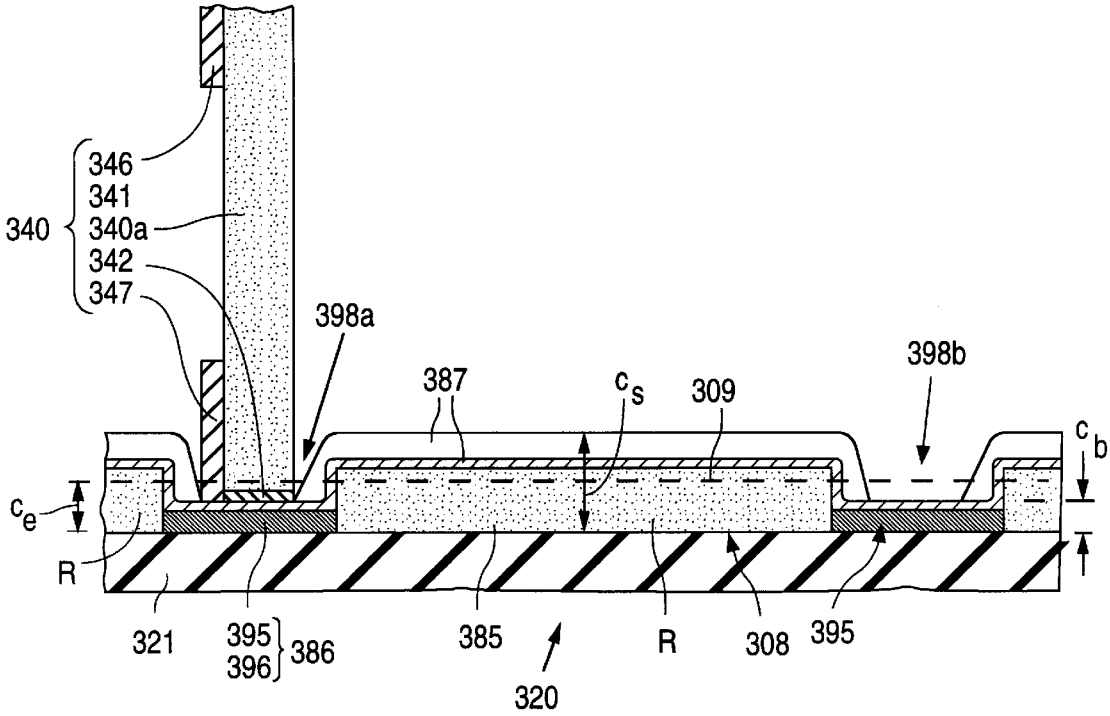
FIG. 21 is a cross-sectional view of the faceplate structure of FIG. 20*b*.

FIGS. 20*a* and 20*b* perspectively illustrate another embodiment of faceplate structure 320 configured to achieve faceplate-side electrical-end matching. FIG. 20*a* shows how faceplate structure 320 appears before anode 387 is formed, and consequently, before spacer 340 is brought into contact with anode 387. FIG. 20*b* depicts the situation after anode 387 is formed and spacer 340 is contacted with anode 387. FIG. 21 presents a cross section of faceplate structure 320 and spacer 340 of FIG. 20*b* taken along the vertical plane indicated by arrow 21 in FIG. 20*b*. Faceplate structure 320 of FIGS. 20*a*, 20*b*, and 21 is a variation of faceplate structure 320 of FIGS. 18*a*, 18*b*, and 19. Accordingly, similar elements in FIGS. 18*a*, 18*b*, 19, 20*a*, 20*b*, and 21 are labeled with the same reference symbols.

The principal difference between faceplate structure 320 of FIGS. 20*a,* 20*b,* and 21 and faceplate structure 320 of FIGS. 18*a,* 18*b,* and 19 is in the configuration of black matrix 386. In FIGS. 20*a,* 20*b,* and 21, black matrix 386 consists of (a) a group of row strips 395 extending in the row direction and (b) a group of taller column strips 396 extending in the column direction. Column strips 396 intersect, and partially overlie, row strips 395 as shown in FIG. 20*a*. A row channel is present above each row strip 395. Two row channels 397*a* and 397*b* are depicted in FIG. 20*a*. Column strips 396 are divided into segments having slanted ends that partially form the sidewalls of the row channels, such as channels 397*a* and 397*b*.

As shown in FIGS. 20*b* and 21, a main structure consisting of anode layer 387 is again formed on light emissive elements 385 and black matrix 386. Row channels 397*a* and 397*b* thereby respectively become channels (recessed spaces) 398*a* and 398*b* in anode 387 of FIGS. 20*b* and 21. The faceplate-side end of spacer 340 is inserted into channel 398*a*. Edge electrode 342 thus contacts anode 387 in channel 398*a*.

Anode layer 387 is shaped differently in faceplate structure 320 of FIGS. 20*b* and 21 than in faceplate structure 320 of FIGS. 18*b* and 19. However, anode 387 still forms a faceplate-side non-planar approximately equipotential surface situated above faceplate plane 308 at a distance varying from $c_b$ to $c_s$. Likewise, the electrical end of faceplate structure 320 of FIGS. 20*b* and 21 is located in backplate-side electrical-end plane 309 at distance $c_e$ above faceplate plane 308.

Spacer 340 in FIGS. 20*b* and 21 can be employed in the same flat panel displays as spacer 340 of FIGS. 18*b* and 19. As with spacer 340 in FIGS. 18*b* and 19, the presence of face electrode 347 in FIGS. 20*b* and 21 causes the faceplate-side electrical end of spacer 340 to be situated along main spacer portion 340*a* at a location spaced apart from faceplate-side edge electrode 342. Subject to substituting channel 398*a* for channel 394, the comments presented above about the faceplate-side electrical-end matching for faceplate structure 320 of FIGS. 18*b* and 19 carry over identically to faceplate structure 320 of FIGS. 20*b* and 21.

As indicated above, components 320 and 340 in FIGS. 18*b* and 19 or in FIGS. 20*b* and 21 can be utilized in flat panel display 500, 700, 800, or 900. Since face electrode 347 is not present in such cases, the location of the faceplate-side electrical end of spacer 340 is shifted to coincide with edge electrode 342.

Figure 22:
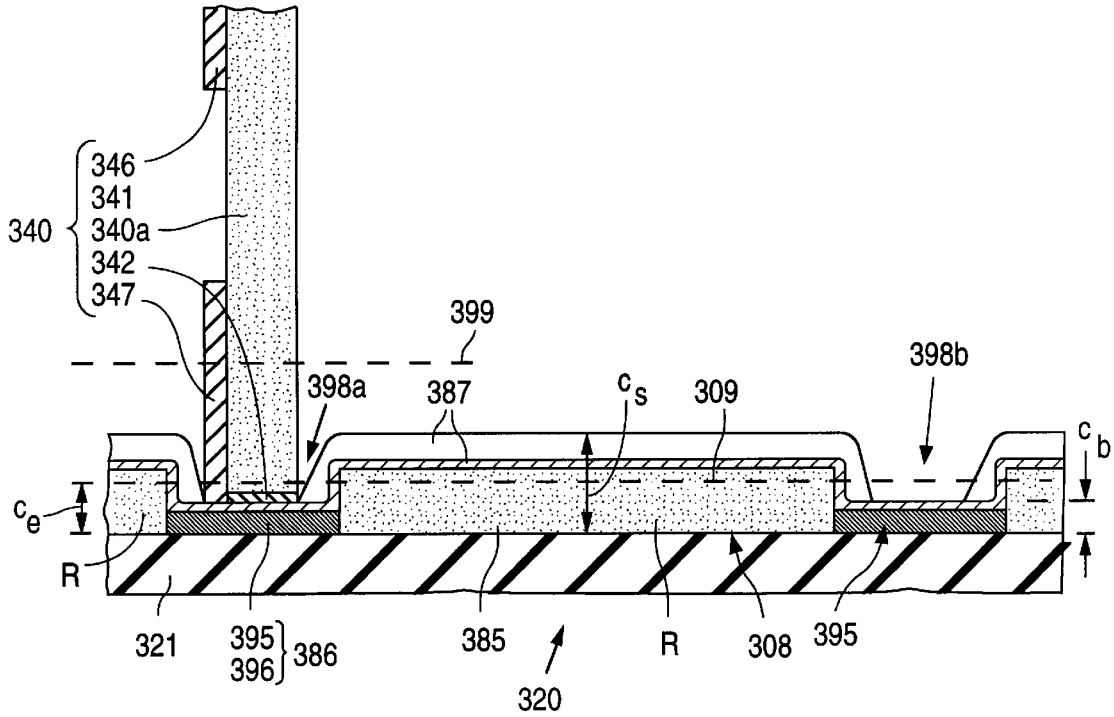
FIG. 22 is a cross-sectional view of a variation of the faceplate structure and spacer of FIG. 21.

The corrective electron deflection variously achieved with face electrodes 346 and 347 in flat panel displays 600 and 650 may sometimes be insufficient to fully compensate for the initial undesired electron deflection that results from the backplate-side electrical end of spacer 340 being located above backplate-side electrical-end plane 304. Further corrective electron deflection is produced by configuring faceplate structure 320 and spacer 340 in the manner generally illustrated in FIG. 22. The configuration depicted in FIG. 22 is a variation of that shown in FIG. 21, similar elements in FIGS. 21 and 22 being labeled with the same reference symbols.

In the configuration of FIG. 22, spacer 340 again consists of main spacer portion 340*a,* faceplate-side edge electrode 342, backplate-side edge electrode 341 (not shown), face electrode 346 (optional here), and face electrode 347. The difference between the configurations of FIGS. 21 and 22 is that face electrode 347 in the configuration of FIG. 22 is sufficiently wide that the spacer's faceplate-side electrical end is moved up spacer 340 sufficiently far towards its backplate-side electrical end that the spacer's faceplate-side electrical end is no longer located approximately in faceplate-side electrical-end plane 309 and thus is no longer approximately coincident with the electrical end of faceplate structure 320. Specifically, the faceplate-side electrical end of spacer 340 in the configuration of FIG. 22 lies in a further spacer electrical-end plane 399 situated above electrical-end plane 309.

The potential at the faceplate-side electrical end of spacer 340 is the voltage applied by the positive side of voltage source 350 to anode 387. By having the spacer's faceplate-side electrical end situated in spacer electrical-end plane 399 above faceplate-side electrical-end plane 309, the potential field along spacer 340 in the vicinity of face electrode 347 is higher than the potential field that would exist at the same location in free space between plate structures 320 and 330. This increased potential field attracts electrons and thereby provides additional corrective electron deflection. The magnitude of the additional compensating electron deflection is determined by various factors, especially the width of face electrode 347.

Figure 23:
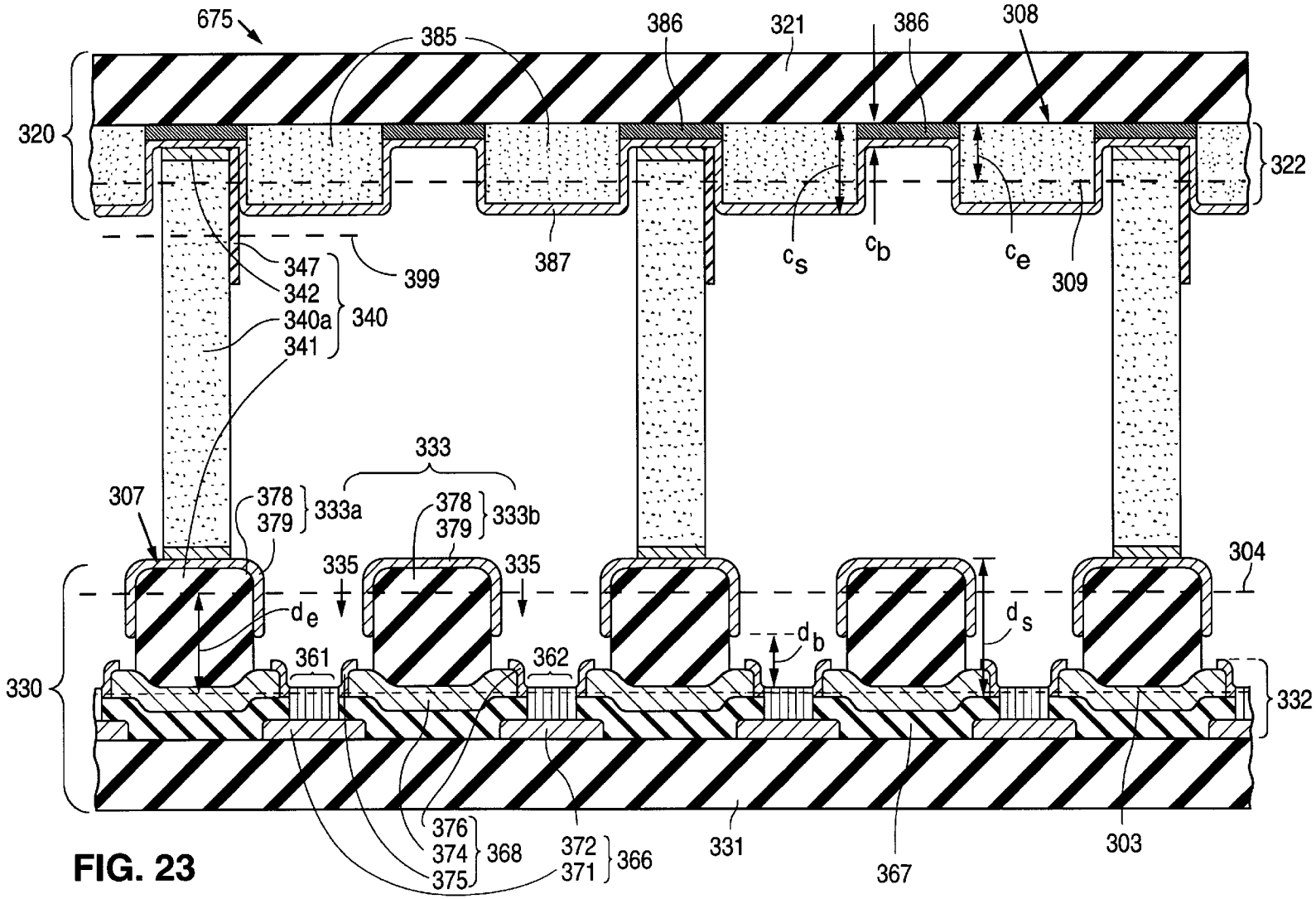
FIG. 23 is a cross-sectional view of a portion of a further flat-panel CRT display which utilizes spacers having face electrodes arrange in accordance with the invention.

FIG. 23 illustrates a variation 675 of flat panel display 650 of FIG. 17 in which the faceplate-side electrical end of spacer 340 is located in spacer electrical-end plane 399 spaced apart from faceplate-side electrical-end plane 309. Because flat panel CRT display 675 is similar to display 650, similar elements in FIGS. 17 and 23 are labeled with the same reference symbols. In display 675 of FIG. 23, spacer electrical-end plane 399 is closer to the spacer's backplate-side electrical end than is faceplate-side electrical-end plane 309.

Spacer 340 in flat panel display 675 does not employ face electrode 346. Also, edge electrode 341 at the backplate-side edge of spacer 340 does not extend in a groove into focusing structure 333*a*. Largely all of the corrective electron deflection produced in display 675 is achieved due to the combination of (a) the presence of face electrode 347 and (b) having the faceplate-side electrical end of spacer 340 closer to its backplate-side electrical end than the electrical end of faceplate structure 320.

Due to various effects, undesired initial electron deflection may occasionally occur in flat panel display 300 or 500 even though the backplate-side electrical end of spacer 340 in display 300 or 500 is approximately coincident with the electrical end of backplate structure 330. In such cases, components 320 and 340 in display 300 or 500 can be configured in the manner shown in FIG. 22 or 23 to provide corrective electron deflection.

Flat panel display 300, 500, 600, 650, 675, 700, 800, or 900 is fabricated in the following manner. Plate structures 320 and 330, spacer 340 and other such spacers, and the outer wall are separately fabricated. With spacer 340 and the other spacers, along with the outer wall, being appropriately inserted between plate structures 320 and 330, the separate display components are assembled in such a way that the pressure inside the sealed display is at a high vacuum, normally $10^{-7}$ torr or less.

The present flat panel CRT display operates in the following way. With particular reference to display 650 or 675, anode layer 387 is maintained at a high positive potential relative to control electrodes 368 and the emitter electrodes of lower non-insulating region 366. When a suitable potential is applied between (a) a selected one of control electrodes 368 and (b) a selected one of the emitter electrodes, the so-selected gate portion, such as gate portion 365 or 366, extracts electrons from the selected set of electron emitting elements, such as set 361 or 362, and controls the magnitude of the resulting electron current. Desired levels of electron emission typically occur when the applied gate-to-cathode parallel plate electric field reaches 20 volts/$\mu$m at a current density of 0.1 mA/cm$^2$ as measured at light emissive elements 385 when they are high-voltage phosphors.

Anode layer 387 attracts the extracted electrons towards the corresponding one of light emissive elements 385. Focusing system 333 helps focus the extracted electrons on corresponding light emissive element 385. When the electrons reach light emitting structure 322, they pass through anode layer 387 and strike corresponding light emissive element 385, causing it to emit light visible on the exterior surface of faceplate 321. Other light emissive elements 385 are selectively activated in the same way. Some of the light emitted by light emissive elements 385 initially travels towards backplate structure 330. Anode layer 387 reflects this light back towards the viewing surface to enhance the image strength.

Directional terms such as "upper" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, face electrodes analogous to face electrode 346 or 370 can be located on both face surfaces of main spacer portion 340*a* approximately opposite each other. Multiple such face electrodes spaced apart from any face electrode that extends to either electrical end of spacer 340 can be provided on either face surface of main spacer portion 340*a*.

Instead of creating main spacer portion 340*a* from electrically resistive material having a largely uniform resistivity, spacer portion 340*a* can consist of an electrically insulating core covered with an electrically resistive coating. The resistive material of spacer portion 340*a* may also be covered with a coating that inhibits secondary emission of electrons.

Anode 387 can be replaced with another main structure which contacts the faceplate-side end of spacer 340 but does not serve as the display's anode. As an example, the main structure could be implemented with a black matrix having an electrically conductive outside surface, while the display's anode consists of a transparent electrical conductive layer situated between faceplate 321 and light emitting structure 322, including the so-modified black matrix.

The principles of the invention can be applied to thin curved CRT displays. In this case, the planes described above are replaced with corresponding curved surfaces. Various modifications and applications may thus be made by those skilled in the art without departing from the true scope and spirit of the invention as defined in the appended claims.

We claim:

1. A flat panel display comprising:

a backplate structure comprising (a) a backplate, (b) an electron emitting structure overlying the backplate and having electron-emission sites situated generally in an emission-site plane, and (c) a primary structure overlying the backplate and having a non-planar approximately equipotential surface extending generally along the emission-site plane at a distance therefrom which varies between first and second values, the backplate structure having an electrical end located in an electrical-end plane extending generally parallel to the emission-site plane at a distance therefrom which lies between the first and second values;

a faceplate structure coupled to the backplate structure to form a sealed enclosure; and a spacer situated between the backplate structure and the faceplate structure for resisting external forces exerted on the display, the spacer having a backplate-side electrical end located approximately in the electrical-end plane.

2. A display as in claim 1 wherein the capacitance between the faceplate structure and an electrically conductive plate situated at the electrical-end plane in a spacer-free region extending along the primary structure approximately equals the capacitance between the faceplate structure and the backplate structure in the spacer-free region.

3. A display as in claim 1 wherein the spacer is situated between the primary and faceplate structures.

4. A display as in claim 3 wherein the primary structure has a recessed space into which the spacer extends, the top of the recessed space extending away from the emission-site plane to a distance therefrom approximately equal to one of the first and second values.

5. A display as in claim 4 wherein the spacer comprises:

a main spacer portion; and an edge electrode overlying an edge of the main spacer portion and extending into the recessed space.

6. A display as in claim 5 wherein the spacer includes a face electrode situated along a face surface of the main spacer portion.

7. A display as in claim 6 wherein the face electrode contacts the edge electrode.

8. A display as in claim 3 wherein the primary structure comprises a focusing system for focusing electrons emitted by the electron-emitting structure.

9. A display as in claim 3 wherein largely none of the non-planar approximately equipotential surface underlies the emission-site plane.

10. A display as in claim 9 wherein the primary structure comprises:

a base structure through which a plurality of apertures extend, each exposing a set of electron emitting elements of the electron emitting structure; and an electrically conductive coating overlying the base structure and extending into the apertures, the conductive coating providing the non-planar approximately equipotential surface.

11. A display as in claim 3 wherein largely none of the non-planar approximately equipotential surface overlies the emission-site plane.

12. A display as in claim 3 wherein the non-planar approximately equipotential surface partially overlies and partially underlies the emission-site plane.

13. A display as in claim 3 wherein the spacer generally becomes more electrically transparent to movement of electrons from the backplate structure to the faceplate structure during operation of the display as the electrical ends of the spacer and the backplate structure become closer to coincident.

14. A display as in claim 1 wherein the faceplate structure comprises (a) a faceplate having an interior surface situated largely in a faceplate plane, (b) a light emitting structure overlying the faceplate along its interior surface, and (c) a main structure overlying the faceplate along its interior surface and having a further non-planar approximately equipotential surface situated over the faceplate plane at a distance therefrom which varies between further first and second values, the faceplate structure having a further electrical end located in a further electrical-end plane situated generally parallel over the faceplate plane at a distance therefrom which lies between the further first and second values, the spacer having a faceplate-side electrical end located approximately in the further electrical-end plane.

15. A display as in claim 14 wherein the spacer is situated between the main and primary structures.

16. A display as in claim 1 wherein the spacer comprises a spacer wall.

17. A flat panel display comprising:

a backplate structure comprising (a) a backplate, (b) an electron emitting structure overlying the backplate and having electron-emission sites situated generally in an emission-site plane, and (c) a primary structure overlying the backplate and having a non-planar approximately equipotential surface extending generally along the emission-site plane at a distance therefrom which varies between first and second values, the backplate structure having an electrical end located in an electrical-end plane extending generally parallel to the emission-site plane at a distance therefrom which lies between the first and second values;

a faceplate structure coupled to the backplate structure to form a sealed enclosure; and a spacer situated between the backplate structure and the faceplate structure for resisting external forces exerted on the display, the spacer having a backplate-side electrical end situated along the primary structure at a location spaced apart from the electrical-end plane, the spacer being provided with compensation structure for controlling the potential field along the spacer so that electrons emitted by the electron emitting structure strike target areas on the faceplate structure rather than striking outside the target areas due to the spacer's backplate-side electrical end being spaced apart from the electrical-end plane.

18. A display as in claim 17 wherein the capacitance between the faceplate structure and an electrically conductive plate situated at the electrical-end plane in a spacer-free region extending along the primary structure approximately equals the capacitance between the faceplate structure and the backplate structure in the spacer-free region.

19. A display as in claim 17 wherein the spacer is situated between the primary and faceplate structures.

20. A display as in claim 19 wherein the spacer's backplate-side electrical end overlies the electrical-end plane and is thereby further away from the emission-site plane than the electrical end of the backplate structure.

21. A display as in claim 20 wherein the compensation structure is spaced apart from the spacer's backplate-side electrical end.

22. A display as in claim 21 further including control means for providing at least one signal to control the compensation means.

23. A display as in claim 21 wherein the spacer comprises:

a main spacer portion; and a face electrode situated along a face surface of the main spacer portion and forming at least part of the compensation structure.

24. A display as in claim 23 wherein the spacer has a faceplate-side electrical end located along the faceplate structure largely opposite the spacer's backplate-side electrical end, the face electrode extending largely to the spacer's faceplate-side electrical end.

25. A display as in claim 24 wherein the spacer further includes a faceplate-side edge electrode situated along an edge of the main spacer portion, extending largely to the faceplate structure, and contacting the face electrode.

26. A display as in claim 25 wherein the spacer further includes a backplate-side edge electrode situated along another edge of the main spacer portion and extending largely to the primary structure.

27. A display as in claim 23 wherein the spacer has a faceplate-side electrical end located along the faceplate structure largely opposite the spacer's backplate-side electrical end, the face electrode spaced apart from both of the spacer's electrical ends.

28. A display as in claim 27 further including voltage-providing means for providing a compensation voltage to the face electrode.

29. A display as in claim 27 wherein the spacer further includes:

a backplate-side edge electrode situated along an edge of the main spacer portion and extending largely to the primary structure; and a faceplate-side edge electrode situated along another edge of the main spacer portion and extending largely to the faceplate structure.

30. A display as in claim 29 wherein the face electrode reaches a correction voltage resistively determined relative to the two edge electrodes.

31. A display as in claim 29 wherein the primary structure comprises a focusing system for focusing electrons emitted by the electron-emitting structure.

32. A display as in claim 29 wherein the primary structure comprises:

a base structure through which a plurality of apertures extend, each exposing a set of electron emitting elements of the electron emitting structure; and an electrically conductive coating overlying the base structure and extending into the apertures, the conductive coating providing the non-planar approximately equipotential surface.

33. A display as in claim 17 wherein the faceplate structure comprises a light emitting structure for emitting light upon being struck by electrons emitted by the electron emitting structure.

34. A display as in claim 17 wherein the faceplate structure comprises (a) a faceplate having an interior surface situated largely in a faceplate plane, (b) a light emitting structure overlying the faceplate along its interior surface, and (c) a main structure overlying the faceplate along its interior surface and having a further non-planar approximately equipotential surface situated over the faceplate plane at a distance therefrom which varies between further first and second values, the faceplate structure having a further electrical end located in a further electrical-end plane situated generally over the faceplate plane at a distance therefrom which lies between the further first and second values, the spacer having a faceplate-side electrical end spaced apart from the further electrical-end plane so as to assist the compensation structure in controlling the potential field along the spacer such that electrons emitting by the electron emitting structure strike the target areas.

35. A display as in claim 34 wherein the spacer's faceplate-side electrical end overlies the further electrical-end plane and is thereby further away from the faceplate plane than the electrical end of the faceplate structure.

36. A display as in claim 35 wherein the spacer is situated between the main and primary structures.

37. A display as in claim 17 wherein the spacer comprises:

a main spacer portion; and a face electrode situated along a face surface of the main spacer portion, forming at least part of the compensation structure, and extending largely to the spacer's faceplate-side electrical end.

38. A display as in claim 17 wherein the spacer comprises a spacer wall.

39. A flat panel display comprising:

a faceplate structure comprising (a) a faceplate having an interior surface situated largely in a faceplate plane, (b) a light emitting structure overlying the faceplate along its interior surface, and (c) a main structure overlying the faceplate along its interior surface and having a non-planar approximately equipotential surface situated over the faceplate plane at a distance therefrom which varies between first and second values, the faceplate structure having an electrical end located in an electrical-end plane situated generally parallel over the faceplate plane at a distance therefrom which lies between the first and second values;

a backplate structure coupled to the faceplate structure to form a sealed enclosure; and a spacer situated between the faceplate structure and the backplate structure for resisting external forces exerted on the display, the spacer having a faceplate-side electrical end located approximately in the electrical-end plane.

40. A display as in claim 39 wherein the capacitance between the backplate structure and an electrically conductive plate situated at the electrical-end plane in a spacer-free region extending along the main structure approximately equals the capacitance between the backplate structure and the faceplate structure in the spacer-free region.

41. A display as in claim 39 wherein the spacer is situated between the main and backplate structures.

42. A display as in claim 41 wherein the main structure has a recessed space into which the spacer extends, the top of the recessed space extending over the faceplate plane to a distance approximately equal to one of the first and second values.

43. A display as in claim 42 wherein the spacer comprises:

a main spacer portion; and an edge electrode overlying an edge of the main spacer portion and extending into the recessed space.

44. A display as in claim 41 wherein the spacer generally becomes more electrically transparent to movement of electrons from the faceplate structure to the backplate structure during operation of the display as the electrical ends of the spacer and the faceplate structure becomes closer to coincident.

45. A display as in claim 41 wherein the main structure comprises an anode for attracting electrons emitted from the backplate structure.

46. A display as in claim 39 wherein the spacer comprises a spacer wall.

47. A flat panel display comprising:

a faceplate structure comprising (a) a faceplate having an interior surface situated largely in a faceplate plane, (b) a light emitting structure overlying the faceplate along its interior surface, and (c) a main structure overlying the faceplate along its interior surface and having a non-planar approximately equipotential surface situated over the faceplate plane at a distance therefrom which varies between first and second values, the faceplate structure having an electrical end located in an electrical-end plane situated generally parallel over the faceplate plane at a distance therefrom which lies between the first and second values;

a backplate structure coupled to the faceplate structure to form a sealed enclosure; and a spacer situated between the faceplate structure and the backplate structure for resisting external forces exerted on the display, the spacer having a faceplate-side electrical end overlying the electrical-end plane so as to be further away from the faceplate plane than the electrical end of the faceplate structure.

48. A display as in claim 47 wherein the capacitance between the backplate structure and an electrically conductive plate situated at the electrical-end plane in a spacer-free region extending along the main structure approximately equals the capacitance between the backplate structure and the faceplate structure in the spacer-free region.

49. A display as in claim 47 wherein the spacer is situated between the main and backplate structures.

50. A display as in claim 47 wherein the spacer comprises:

a main spacer portion; and a face electrode situated along a face surface of the main spacer portion, forming at least part of the compensation structure, and extending largely to the spacer's faceplate-side electrical end.

51. A display as in claim 47 wherein the main structure comprises an anode for attracting electrons emitted from the backplate structure.

52. A display as in claim 47 wherein the spacer comprises a spacer wall.

53. A method comprising the steps of:

forming a backplate structure to comprise (a) a backplate, (b) an electron emitting structure overlying the backplate and having electron-emission sites situated generally in an emission-site plane, and (c) a primary structure overlying the backplate and having a non-planar approximately equipotential surface extending generally along the emission-site plane at a distance therefrom which varies between first and second values, the backplate structure having an electrical end located in an electrical-end plane extending generally parallel to the emission-site plane at a distance therefrom which lies between the first and second values; and coupling the backplate structure to the faceplate structure with a spacer inserted therebetween such that the spacer has an electrical end located approximately in the electrical-end plane.

54. A method as in claim 53 wherein the coupling step entails inserting the spacer between the primary and faceplate structures.

55. A method as in claim 54 wherein:

the forming step includes providing the primary structure with a recessed space; and the coupling step includes inserting an edge of the spacer into the recessed space.

56. A method as in claim 54 further including the step of forming the spacer to comprise a main spacer portion and an edge electrode overlying an edge of the main spacer portion.

57. A method comprising the steps of:

forming a backplate structure to comprise (a) a backplate, (b) an electron emitting structure overlying the backplate and having electron-emissive sites situated generally in an emission-site plane, and (c) a primary structure overlying the backplate and having a non-planar approximately equipotential service extending generally along the emission-site plane at a distance therefrom which varies between first and second values, the backplate structure having an electrical end located in an electrical-end plane extending generally parallel to the emission-site plane at a distance therefrom which lies between the first and second values; and coupling the backplate structure to the faceplate structure with a spacer inserted therebetween such that the spacer has a backplate-side electrical end situated along the primary structure at a location spaced apart from the electrical-end plane, the spacer being provided with a compensation structure for controlling the potential field along the spacer so that electrons emitted by the electron-emitting structure strike target areas on the faceplate structure rather than striking outside the target areas due to the spacer's backplate-side electrical end being spaced apart from the electrical-end plane.

58. A method as in claim 57 wherein the coupling step entails inserting the spacer between the primary and faceplate structures.

59. A method as in claim 58 wherein the coupling step further entails arranging for the spacer's backplate-side electrical end to be further away from the emission-site plane than the electrical end of the backplate structure.

60. A method as in claim 59 wherein the coupling step further entails arranging for the compensation structure to be spaced apart from the spacer's backplate-side electrical end.

* * * * *